US011426621B2

(12) United States Patent
Bauerle

(10) Patent No.: US 11,426,621 B2
(45) Date of Patent: Aug. 30, 2022

(54) EXERCISE APPARATUSES

(71) Applicant: Fusion Consults, LLC, Myrtle Beach, SC (US)

(72) Inventor: Wayne Bryan Bauerle, Myrtle Beach, SC (US)

(73) Assignee: Fusion Consults, LLC, Myrtle Beach, SC (US)

( * ) Notice: Subject to any disclaimer, the term of this patent is extended or adjusted under 35 U.S.C. 154(b) by 246 days.

(21) Appl. No.: 16/710,326

(22) Filed: Dec. 11, 2019

(65) Prior Publication Data

US 2020/0188724 A1 Jun. 18, 2020

Related U.S. Application Data

(60) Provisional application No. 62/778,367, filed on Dec. 12, 2018.

(51) Int. Cl.
*A63B 21/00* (2006.01)
*A63B 21/072* (2006.01)

(52) U.S. Cl.
CPC ..... *A63B 21/4035* (2015.10); *A63B 21/0724* (2013.01); *A63B 21/4049* (2015.10)

(58) Field of Classification Search
CPC ..... A63B 21/0724; A63B 21/4035; A63B 21/4049
See application file for complete search history.

(56) References Cited

U.S. PATENT DOCUMENTS

| | | | | | |
|---|---|---|---|---|---|
| 3,384,370 | A * | 5/1968 | Bailey | A63B 21/0724 | 482/106 |
| 4,690,400 | A * | 9/1987 | Metz | A63B 21/00069 | 482/106 |
| 4,822,035 | A * | 4/1989 | Jennings | A63B 21/0724 | 482/106 |
| RE33,218 | E * | 5/1990 | Twardosz | A63B 21/0724 | 482/106 |
| 5,024,434 | A * | 6/1991 | Smith | A63B 21/0728 | 482/106 |
| 8,672,815 | B1 * | 3/2014 | Springer | A63B 21/0724 | 482/106 |
| 2008/0176723 | A1 * | 7/2008 | Johnson | A63B 21/0724 | 482/106 |
| 2018/0243605 | A1 * | 8/2018 | Light | A63B 21/072 | |

* cited by examiner

*Primary Examiner* — Joshua Lee
(74) *Attorney, Agent, or Firm* — MacMillan, Sobanski & Todd, LLC

(57) ABSTRACT

Exercise apparatuses are described herein. An example embodiment of an exercise apparatus includes a first shaft, a first frame, a first handle, a second frame, a second handle, a second shaft, and a third shaft. The first frame is attached to the first shaft. The first handle is rotatably attached to the first frame such that the first handle can rotate relative to the first frame. The second frame is attached to the first shaft. The second handle is rotatably attached to the second frame such that the second handle can rotate relative to the second frame. The second shaft is attached to the first frame and the third shaft is attached to the second frame.

20 Claims, 36 Drawing Sheets

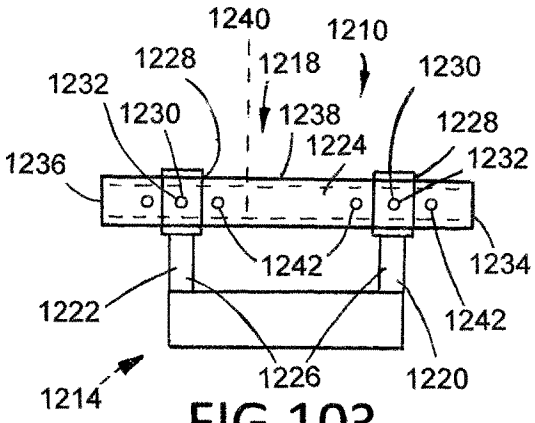
FIG.102
FIG.103
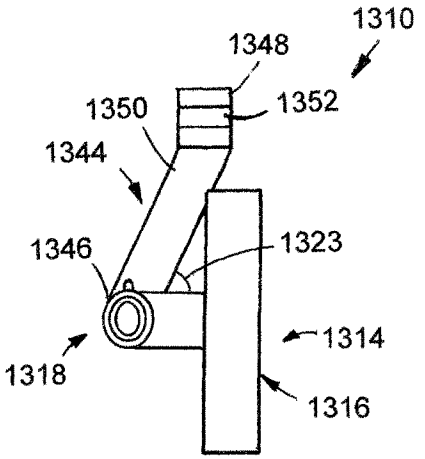
FIG.104

EXERCISE APPARATUSES

This application claims the benefit of U.S. Provisional Application No. 62/778,367, filed on Dec. 12, 2018. The entire disclosure of this related application is hereby incorporated into this disclosure by reference.

FIELD

The disclosure relates generally to the field of exercise apparatuses. More particularly, the disclosure relates to exercise apparatuses that include a rotatable handle.

BACKGROUND

A common exercise performed by weightlifters is the bench press, which exercises the chest, triceps, and shoulders. To perform a bench press, the back is positioned flat on a bench at an angle relative to the floor on which the feet are positioned. Subsequently, the hands are positioned on a bar and a lift is performed. The placement of the hands on the bar is generally based on a specific distance from the center of the bar or markings incorporated into the bar, which are not customized to a specific weightlifter and can result in a less efficient lift. In addition, during a lift, the position of the hands is prevented from being manipulated since they are rotationally fixed relative to the bar throughout the lift, which can increase stress on the shoulders and the surrounding tissues. Other exercises have similar drawbacks due to the fixed position of the hands relative to the lifting device during use.

Therefore, a need exists for new and useful exercise apparatuses.

SUMMARY OF SELECTED EXAMPLE EMBODIMENTS

Various exercise apparatuses are described herein.

An example exercise apparatus includes a first shaft, a first frame, a first handle, a second frame, a second handle, a second shaft, and a third shaft. The first shaft has a first shaft first end and a first shaft second end. The first frame is attached to the first shaft first end. The first frame defines a first frame passageway. The first handle is rotatably attached to the first frame and extends across the first frame passageway. The second frame is attached to the first shaft second end. The second frame defines a second frame passageway. The second handle is rotatably attached to the second frame and extends across the second frame passageway. The second shaft has a second shaft first end and a second shaft second end. The second shaft second end is attached to the first frame. The third shaft has a third shaft first end and a third shaft second end. The third shaft first end is attached to the second frame.

Another example exercise apparatus includes a first shaft, a first frame, a first handle, a second frame, a second handle, a second shaft, and a third shaft. The first shaft has a first shaft first end and a first shaft second end. The first frame is releasably attached to the first shaft first end. The first frame defines a first frame passageway. The first handle is rotatably attached to the first frame and extends across the first frame passageway. The second frame is releasably attached to the first shaft second end. The second frame defines a second frame passageway. The second handle is rotatably attached to the second frame and extends across the second frame passageway. The second shaft has a second shaft first end and a second shaft second end. The second shaft second end is attached to the first frame. The third shaft has a third shaft first end and a third shaft second end. The third shaft first end is attached to the second frame.

Another example exercise apparatus includes a first shaft, a first frame, a first handle, a second frame, a second handle, a second shaft, and a third shaft. The first shaft has a first shaft first end and a first shaft second end. The first frame is releasably attached to the first shaft first end. The first frame defines a first frame passageway and is moveable relative to the first shaft. The first handle is rotatably attached to the first frame and extends across the first frame passageway. The first handle has 360 degrees of rotation relative to the first frame. The second frame is releasably attached to the first shaft second end. The second frame defines a second frame passageway and is moveable relative to the first shaft. The second handle is rotatably attached to the second frame and extends across the second frame passageway. The second handle has 360 degrees of rotation relative to the second frame. The second shaft has a second shaft first end and a second shaft second end. The second shaft second end is attached to the first frame. The third shaft has a third shaft first end and a third shaft second end. The third shaft first end is attached to the second frame.

Additional understanding of the example exercise apparatuses can be obtained by review of the detailed description, below, and the appended drawings.

BRIEF DESCRIPTION OF THE DRAWINGS

FIG. 102 is a perspective view of another example exercise apparatus.

FIG. 103 is a top view of the exercise apparatus illustrated in FIG. 102.

FIG. 104 is a side view of another example exercise apparatus.

DETAILED DESCRIPTION

Figure 1:
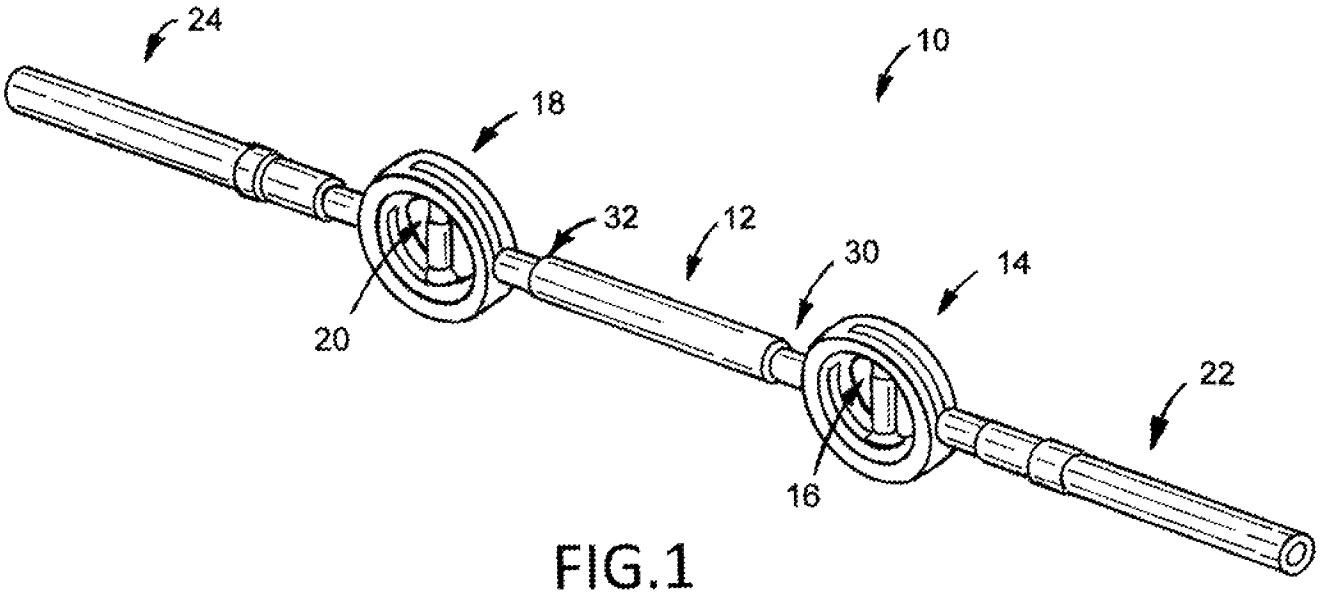
FIG. 1 is a perspective view of an example exercise apparatus.

The following detailed description and the appended drawings describe and illustrate various example embodiments of exercise apparatuses. The description and illustration of these examples are provided to enable one skilled in the art to make and use an exercise apparatus. They are not intended to limit the scope of the claims in any manner.

FIGS. 1 through 32 illustrate a first example exercise apparatus 10. The exercise apparatus 10 includes a first shaft 12, a first frame 14 releasably attached, and moveable relative, to the first shaft 12, a first handle 16 attached, and moveable relative, to the first frame 14, a second frame 18 releasably attached, and moveable relative, to the first shaft 12, a second handle 20 attached, and moveable relative, to the second frame 18, a second shaft 22 releasably attached, and moveable relative, to the first frame 14, and a third shaft 24 releasably attached, and moveable relative, to the second frame 18.

Figure 4:
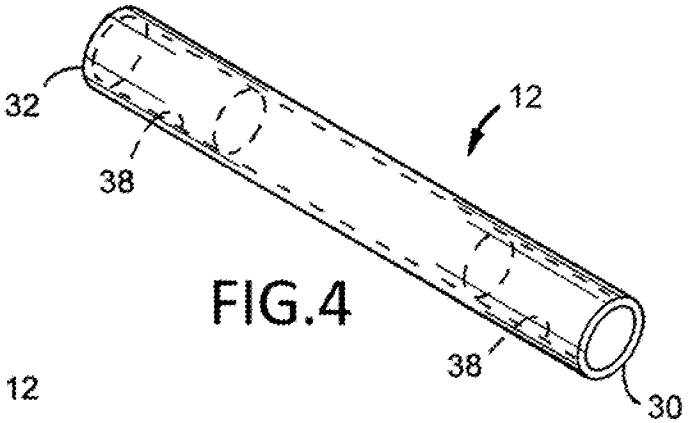
FIG. 4 is a perspective view of the first shaft of the exercise apparatus illustrated in FIG. 1.
Figure 6:
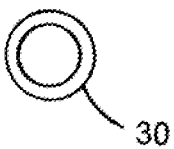
FIG. 6 is a side view of the first shaft illustrated in FIG. 4.
Figure 5:
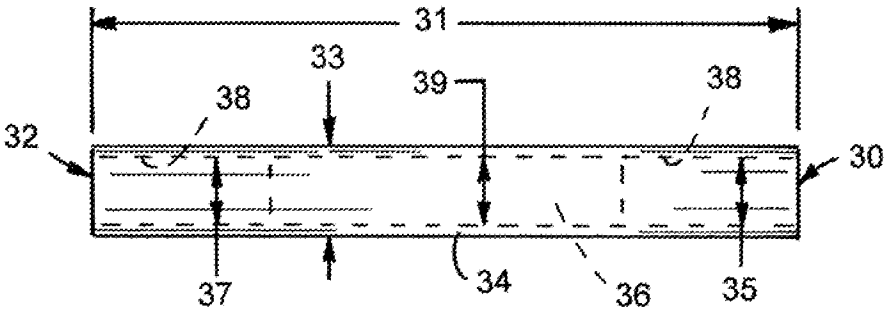
FIG. 5 is a front view of the first shaft illustrated in FIG. 4.

In the illustrated embodiment, and as best shown in FIGS. 4, 5, and 6, the first shaft 12 has a first shaft first end 30, a first shaft second end 32, a first shaft length 31 that extends from the first shaft first end 30 to the first shaft second end 32, a first shaft outside diameter 33, and a first shaft main body 34 that defines a first shaft passageway 36 and first shaft threads 38. The first shaft passageway 36 extends from the first shaft first end 30 to the first shaft second end 32 and is sized and configured to receive a portion of the first frame 14 and the second frame 18. The first shaft passageway 36 has a first shaft passageway first inside diameter 35, a first shaft passageway second inside diameter 37, and a first shaft passageway third inside diameter 39. The first shaft passageway first inside diameter 35 extends from the first shaft first end 30 toward the first shaft second end 32 a distance equal to about 4 inches. The first shaft passageway second inside diameter 35 extends from the first shaft second end 32 toward the first shaft first end 30 a distance equal to about 4 inches. The first shaft passageway third inside diameter 39 extends from a location where the first shaft passageway first inside diameter 35 ends to a location where the first shaft passageway second inside diameter 37 ends and extends along the first shaft lengthwise axis a distance equal to about 8 inches. In the illustrated embodiment, the first shaft length 31 is equal to about 16 inches, the first shaft outside diameter 33 is equal to about 2 inches, the first shaft passageway first inside diameter 35 is equal to about 1.5 inches, the first shaft passageway second inside diameter 37 is equal to about 1.5 inches, and the first shaft passageway third inside diameter 39 is equal to about 1.63 inches.

The first shaft main body 34 defines a first shaft thread 38 along the portion of the first shaft 12 that includes the first shaft first inside diameter 35 and a first shaft thread 38 along the portion of the first shaft 12 that includes the first shaft second inside diameter 37. The first shaft thread 38 that extends along the portion of the first shaft 12 that includes the first shaft first inside diameter 35 is a 1.50-5 RH ACME thread. The first shaft thread 38 that extends along the portion of the first shaft 12 that includes the first shaft second inside diameter 37 is a 1.50-5 LH ACME thread.

Figure 2:
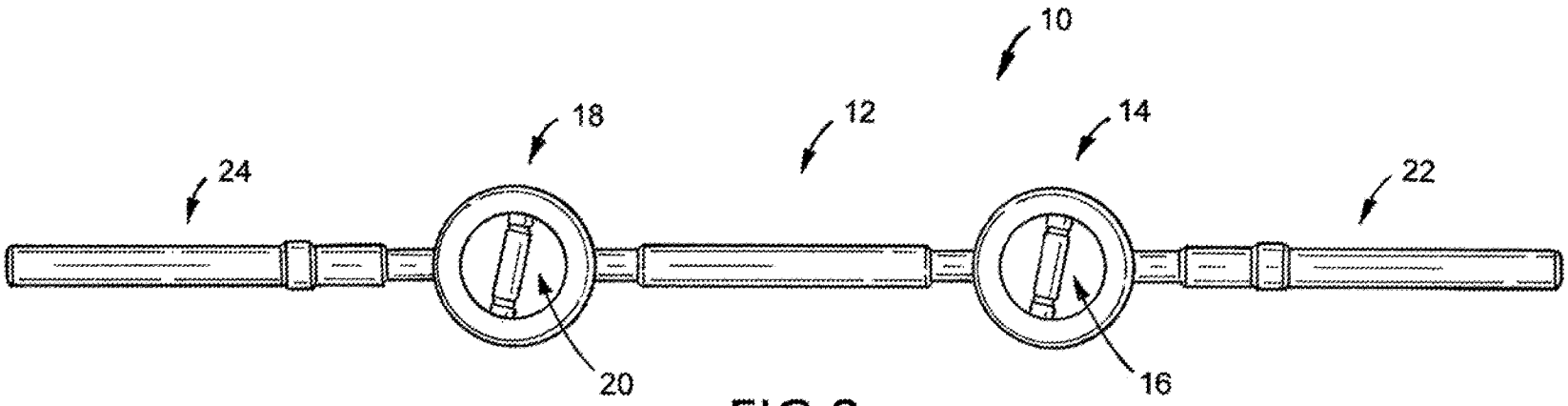
FIG. 2 is a front view of the exercise apparatus illustrated in FIG. 1.
Figure 3:
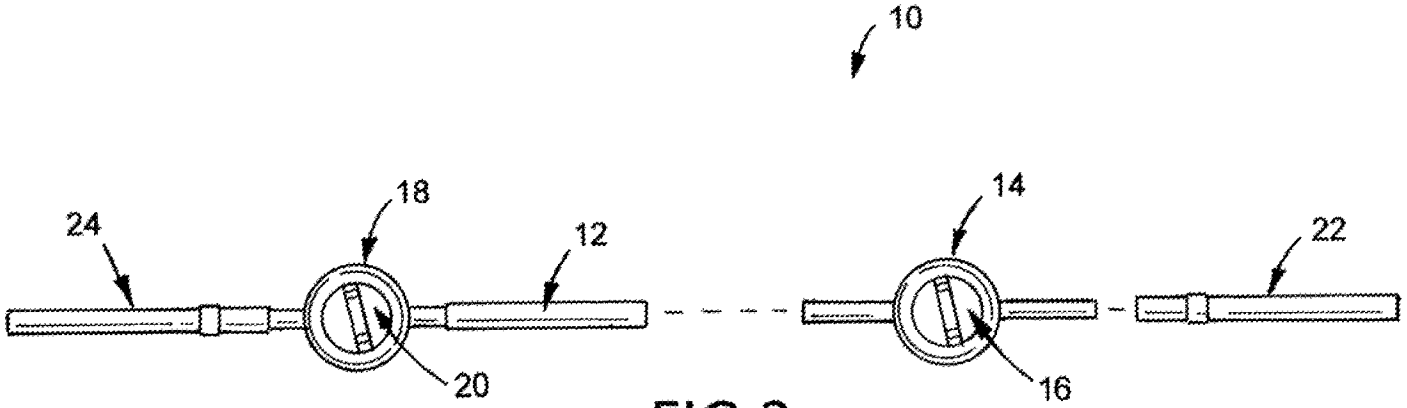
FIG. 3 is a partial exploded view of the exercise apparatus illustrated in FIG. 1.

In the illustrated embodiment, as best shown in FIGS. 1 through 3, each of the first frame 14 and the second frame 18 is releasable attached to the first shaft 12 and can be moved along the length of the first shaft 12, as described herein. The first frame 14 is attached to the first shaft first end 30 and the second frame 18 is attached to the first shaft second end 32. While the first shaft 12 has been illustrated as having a particular structural arrangement and as having various dimensions, a first shaft of an exercise apparatus can have any suitable structural arrangement and dimensions. Selection of suitable structural arrangement and dimensions for a first shaft can be based on various considerations, including the intended use of the exercise apparatus of which the first shaft is included.

As best shown in FIGS. 7, 8, 9, and 9A each of the first frame 14 and the second frame 18 includes a first inner ring 42, a second inner ring 44, a third inner ring 46 moveably disposed (e.g., pivotally, rotatably) between the first inner ring 42 and the second inner ring 44, an outer ring 48 attached to each of the first inner ring 42 and the second inner ring 44, a first elongate member 50, a second elongate member 52, a plurality of ball bearings 54, and defines a passageway 56.

In the illustrated embodiment, as best shown in FIGS. 10, 11, 12, and 13, the first inner ring 42 is a ring member that has a first inner ring first surface 58, a first inner ring second surface 60, a first inner ring inner surface 62, a first inner ring outer surface 64, a first inner ring outside diameter 57 equal to about 8.54 inches, a first inner ring inside diameter 59 equal to about 6 inches, a first inner ring thickness 61 equal to about 0.5 inches, and a first inner ring main body 66 that defines a first inner ring recess 68. The first inner ring recess 68 extends about the entire circumference of the first inner ring 42 and from the first inner ring first surface 58 toward the first inner ring second surface 60 a has depth equal to about 0.17 inches. The first inner ring recess 68 is disposed a distance from the first inner ring inner surface 62 equal to about 0.30 inches, has a width equal to about 0.47 inches, and is disposed a distance from the first inner ring outer surface 64 equal to about 0.50 inches. The first inner ring recess 68 is sized and configured to receive a portion of each ball bearing of a first set of the plurality of ball bearings 54. While the first inner ring 42 has been illustrated as having a particular structural arrangement and as having various dimensions, a first inner ring of an exercise apparatus can have any suitable structural arrangement and dimensions. Selection of suitable structural arrangement and dimensions for a first inner ring can be based on various considerations, including the intended use of the exercise apparatus of which the first inner ring is included. For example, a first inner ring can alternatively define a first inner ring recess that does not extend about the entire circumference of a first inner ring (e.g., a first inner ring recess that only partially extends about the circumference of a first inner ring).

In the illustrated embodiment, as best shown in FIGS. 14, 15, 16, and 17, the second inner ring 44 is a ring member that has a second inner ring first surface 70, a second inner ring second surface 72, a second inner ring inner surface 74, a second inner ring outer surface 76, a second inner ring outside diameter 71 equal to about 8.54 inches, a second inner ring inside diameter 73 equal to about 6 inches, a second inner ring thickness 75 equal to about 0.5 inches, and a second inner ring main body 78 that defines a second inner ring recess 80. The second inner ring recess 80 extends about the entire circumference of the second inner ring 44 and from the second inner ring first surface 70 toward the second inner ring second surface 72 a has depth equal to about 0.17 inches. The second inner ring recess 80 is disposed a distance from the second inner ring inner surface 74 equal to about 0.30 inches, has a width equal to about 0.47 inches, and is disposed a distance from the second inner ring outer surface 76 equal to about 0.50 inches. The second inner ring recess 80 is sized and configured to receive a portion of each ball bearing of a second set of the plurality of ball bearings 54. While the second inner ring 44 has been illustrated as having a particular structural arrangement and as having various dimensions, a second inner ring of an exercise apparatus can have any suitable structural arrangement and dimensions. Selection of suitable structural arrangement and dimensions for a second inner ring can be based on various considerations, including the intended use of the exercise apparatus of which the second inner ring is included. For example, a second inner ring can alternatively define a second inner ring recess that does not extend about the entire circumference of a second inner ring (e.g., a second inner ring recess that only partially extends about the circumference of a second inner ring).

Figure 9A:
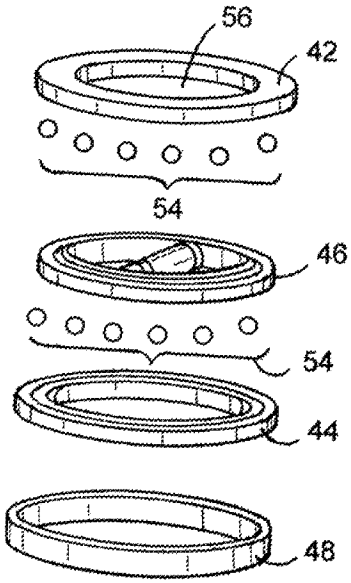
FIG. 9A is a partial exploded view of the frame and handle illustrated in FIG. 7.
Figure 9:
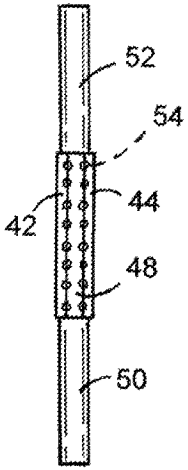
FIG. 9 is a side view of the frame and handle illustrated in FIG. 7.

In the illustrated embodiment, as best shown in FIGS. 18, 19, 20, and 21, the third inner ring 46 has a third inner ring first surface 82, a third inner ring second surface 84, a third inner ring inner surface 86, a third inner ring outer surface 88, a third inner ring outside diameter equal to about 7.69 inches, a third inner ring inside diameter equal to about 6.44 inches, a third inner ring thickness 87 equal to about 0.5 inches, and a third inner ring main body 90 that defines a third inner ring first recess 92 and a third inner ring second recess 94. The third inner ring 46 is moveably disposed (e.g., pivotally, rotatably) between the first inner ring 42 and the second inner ring 44 using the plurality of ball bearings 54, as shown in FIG. 9. A first set of ball bearings of the plurality of ball bearings 54 is disposed between the third inner ring 46 and the first inner ring 42 and a second set of ball bearings of the plurality of ball bearings 54 is disposed between the third inner ring 46 and the second inner ring 44.

The third inner ring first recess 92 extends about the entire circumference of the third inner ring 46 and from the third inner ring first surface 82 toward the third inner ring second surface 84 a depth equal to about 0.17 inches. The third inner ring first recess 92 is disposed a distance from the third inner ring inner surface 86 equal to about 0.08 inches, has a width equal to about 0.47 inches, and is disposed a distance from the third inner ring outer surface 88 equal to about 0.08 inches. The third inner ring first recess 92 is sized and configured to receive a portion of each ball bearing of the first set of the plurality of ball bearings 54. The third inner ring second recess 94 extends about the entire circumference of the third inner ring 46 and from the third inner ring second surface 84 toward the third inner ring first surface 82 a depth equal to about 0.17 inches. The third inner ring second recess 94 is disposed a distance from the third inner ring inner surface 86 equal to about 0.08 inches, has a width equal to about 0.47 inches, and is disposed a distance from the third inner ring outer surface 88 equal to about 0.08 inches. The third inner ring second recess 94 is sized and configured to receive a portion of each ball bearing of the second set of the plurality of ball bearings 54.

While the third inner ring 46 has been illustrated as having a particular structural arrangement and as having various dimensions, a third inner ring of an exercise apparatus can have any suitable structural arrangement and dimensions. Selection of suitable structural arrangement and dimensions for a third inner ring can be based on various considerations, including the intended use of the exercise apparatus of which the third inner ring is included. For example, a third inner ring can alternatively define a third inner ring first recess and/or a third inner ring second recess that does not extend about the entire circumference of a third inner ring (e.g., a third inner ring first recess and/or a third inner ring second recess that only partially extends about the circumference of a third inner ring).

Figure 7:
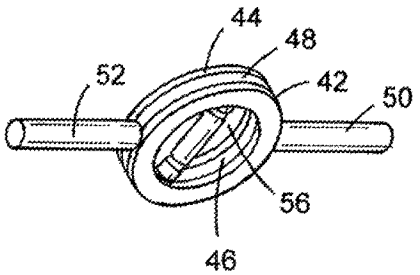
FIG. 7 is a perspective view of a frame and handle of the exercise apparatus illustrated in FIG. 1.
Figure 22:
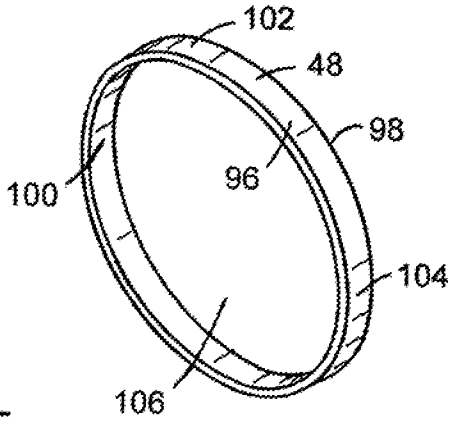
FIG. 22 is a perspective view of an outer ring of a frame of the exercise apparatus illustrated in FIG. 1.
Figure 24:
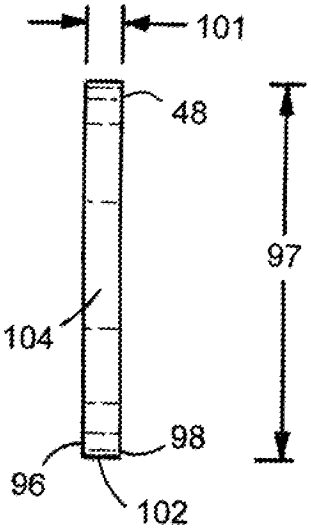
FIG. 24 is a side view of the outer ring illustrated in FIG. 22.
Figure 23:
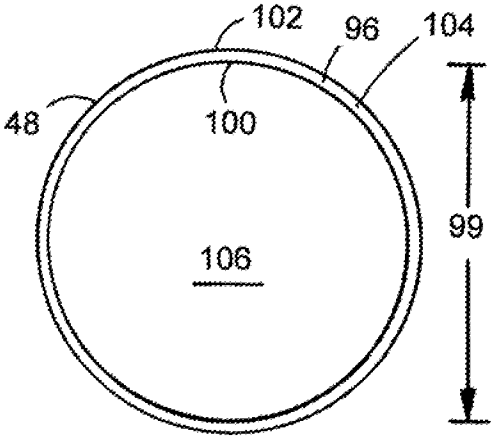
FIG. 23 is a front view of the outer ring illustrated in FIG. 22.

In the illustrated embodiment, as shown best in FIGS. 22, 23, and 24, the outer ring 48 has an outer ring first surface 96, an outer ring second surface 98, an outer ring inner surface 100, an outer ring outer surface 102, an outer ring outside diameter 97 equal to about 8.54 inches, an outer ring inside diameter 99 equal to about 8.16 inches, an outer ring thickness 101 equal to about 0.84 inches, and an outer ring main body 104 that defines an outer ring passageway 106. The outer ring passageway 106 extends from the outer ring first surface 96 to the outer ring second surface 98 and is sized and configured to receive a portion of the first inner ring 42, the second inner ring 44, and the third inner ring 46. When a frame is assembled, as shown in FIG. 7, the outer ring 48 is attached to each of the first inner ring 42 and the second inner ring 44 and the third inner ring 46 is moveable within the outer ring 48 and between the first inner ring 42 and the second inner ring 44. While the outer ring 48 has been illustrated as having a particular structural arrangement and as having various dimensions, an outer ring of an exercise apparatus can have any suitable structural arrangement and dimensions. Selection of suitable structural arrangement and dimensions for an outer ring can be based on various considerations, including the intended use of the exercise apparatus of which the outer ring is included.

Figure 8:
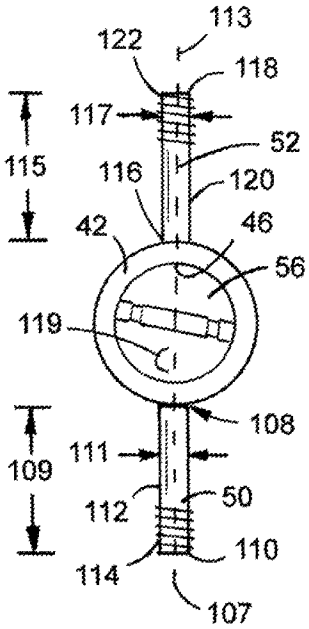
FIG. 8 is a front view of the frame and handle illustrated in FIG. 7.
Figure 10:
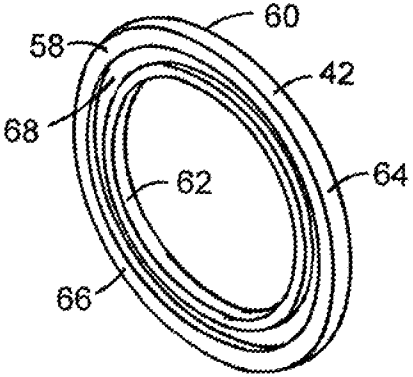
FIG. 10 is a perspective view of a first inner ring of a frame of the exercise apparatus illustrated in FIG. 1.
Figure 13:
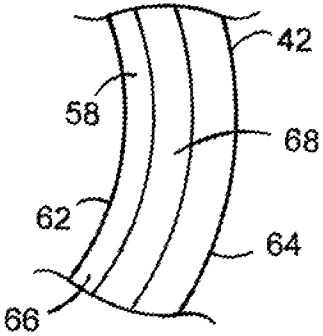
FIG. 13 is a magnified view of area 13-13 in FIG. 11.
Figure 12:
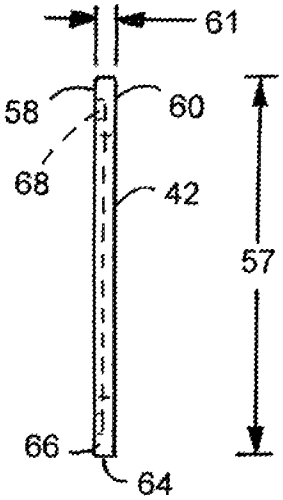
FIG. 12 is a side view of the first inner ring illustrated in FIG. 10.
Figure 11:
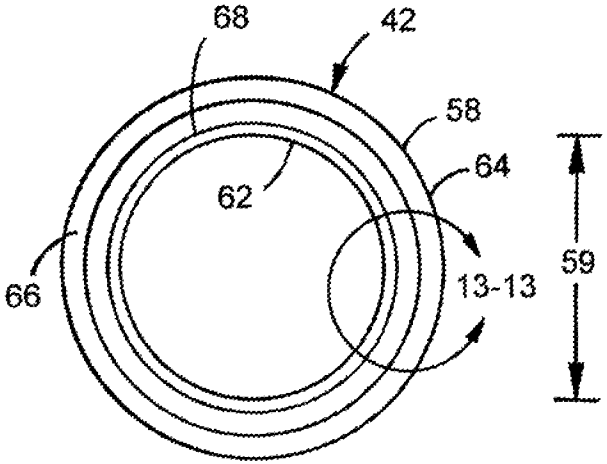
FIG. 11 is a front view of the first inner ring illustrated in FIG. 10.
Figure 14:
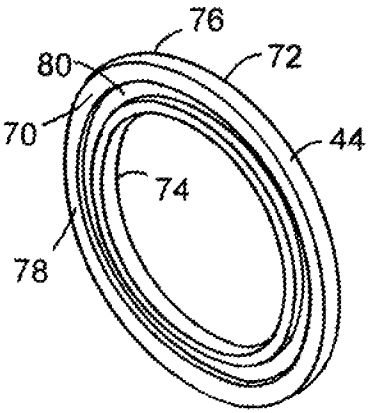
FIG. 14 is a perspective view of a second inner ring of a frame of the exercise apparatus illustrated in FIG. 1.
Figure 17:
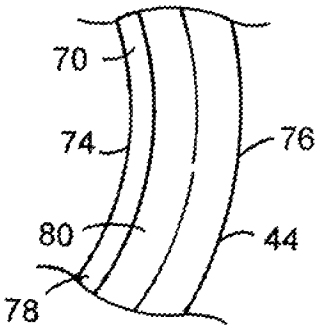
FIG. 17 is a magnified view of area 17-17 in FIG. 15.
Figure 16:
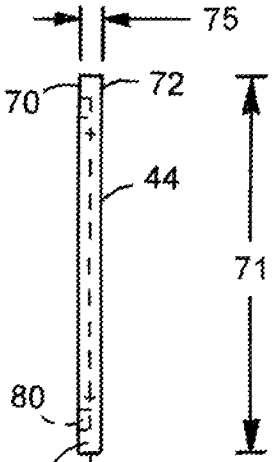
FIG. 16 is a side view of the second inner ring illustrated in FIG. 14.
Figure 15:
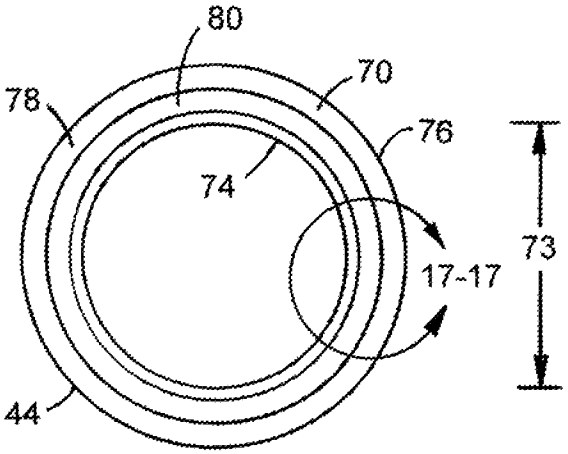
FIG. 15 is a front view of the second inner ring illustrated in FIG. 14.
Figure 18:
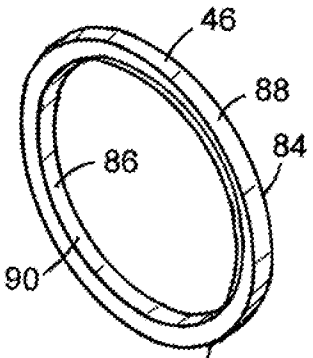
FIG. 18 is a perspective view of a third inner ring of a frame of the exercise apparatus illustrated in FIG. 1.
Figure 21:
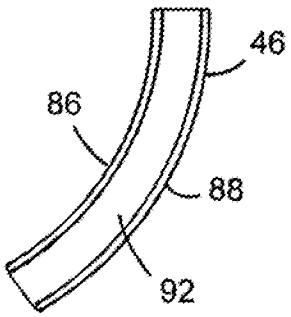
FIG. 21 is a magnified view of area 21-21 in FIG. 19.
Figure 20:
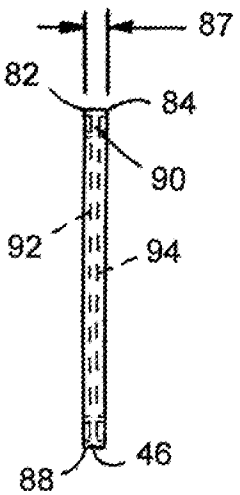
FIG. 20 is a side view of the third inner ring illustrated in FIG. 18.
Figure 19:
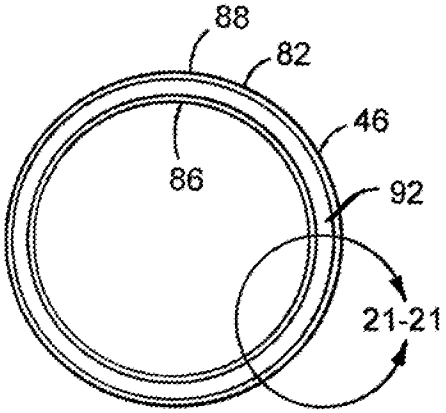
FIG. 19 is a front view of the third inner ring illustrated in FIG. 18.

In the illustrated embodiment, as shown best in FIGS. 7, 8, and 9, each of the first elongate member 50 and the second elongate member 52 is attached to the first inner ring 42, the second inner ring 44, and the outer ring 48 (e.g., welding, fusing). The first elongate member 50 has a first elongate member lengthwise axis 107, a first elongate member first end 108, a first elongate member second end 110, a first elongate member length 109 that extends from the first elongate member first end 108 to the first elongate member second end 110, a first elongate member outside diameter 111, and a main body 112 that defines first elongate member threads 114. In the illustrated embodiment, the first elongate member length 109 is equal to about 7.5 inches and the first elongate member outside diameter 111 is equal to about 1.5 inches. The first elongate member threads 112 are sized and configured to mate with the threads 160 defined by the second shaft 22 or the threads 170 defined by the third shaft 24. The second elongate member 52 has a second elongate member lengthwise axis 113, a second elongate member first end 116, a second elongate member second end 118, a second elongate member length 115 that extends from the second elongate member first end 116 to the second elongate member second end 118, a second elongate member outside diameter 117, and a second elongate member main body 120 that defines second elongate member threads 122. In the illustrated embodiment, the second elongate member length 115 is equal to about 7.5 inches and the second elongate member outside diameter 117 is equal to about 1.5 inches. The second elongate member threads 122 are sized and configured to mate with a first shaft thread 38 defined by the first shaft 12. The first elongate member lengthwise axis 107 is disposed at an angle 119 to the second elongate member lengthwise axis 113. In the illustrated embodiment, the angle 119 is equal to 180 degrees such that the first elongate member lengthwise axis 107 is coaxial to the second elongate member lengthwise axis 113. While each of the first elongate member 50 and the second elongate member 52 has been illustrated as having a particular structural arrangement and as having various dimensions, a first elongate member and a second elongate member of an exercise apparatus can have any suitable structural arrangement and dimensions. Selection of suitable structural arrangement and dimensions for a first elongate member and a second elongate member can be based on various considerations, including the intended use of the exercise apparatus of which the first elongate member and the second elongate member is included. In addition, alternative embodiments can include a second elongate member that is defined at any suitable angle relative to a first elongate member (e.g., angles less than 180 degrees, angles between 45 degrees and 180 degrees).

Optionally, each of the first frame and the second frame can include a plurality of markers. Each marker of the plurality of markers can be disposed on an elongate member of a frame and extend around a portion, or the entirety, of the elongate member. Each marker can also have any suitable length along an elongate member length. A marker can be formed in any suitable manner, such as by embedding material with a color different than the color of the material that forms a frame within the material that forms the frame and/or applying a material with a color different than the color that forms the material of a frame on an exterior surface of an elongate member. A first marker of the plurality of markers can be disposed on an elongate member (e.g., first frame first elongate member, first frame second elongate member, second frame first elongate member, second frame second elongate member) a first distance from the first inner ring and a second marker of the plurality of markers can be disposed on the elongate member (e.g., first frame first elongate member, first frame second elongate member, second frame first elongate member, second frame second elongate member) a second distance from the first inner ring that is different than the first distance. Each marker can be formed of a material having the same color, or each marker can be formed of a material that has a color that is different from an adjacent marker such that a first marker is formed of a material that has a first color and a second marker is formed of a material that has a second color that is different than the first color. The inclusion of a plurality of markers provides a user with a mechanism for positioning a first frame and a second frame relative to the user and for indicating a distance disposed between the markers. For example, the inclusion of markers, and the structural arrangement of the exercise apparatuses described herein, allows a user to adjust the exercise apparatus to confirm with the user's grip (e.g., distance between arms).

Figure 25:
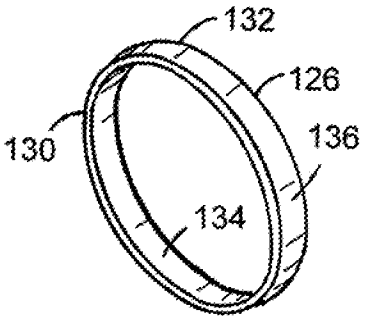
FIG. 25 is a perspective view of a handle outer ring of a handle of the exercise apparatus illustrated in FIG. 1.
Figure 27:
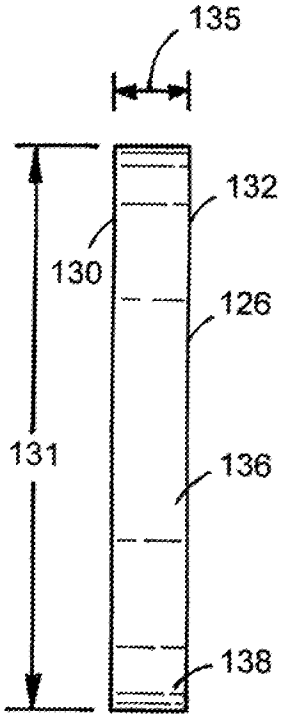
FIG. 27 is a side view of the handle outer ring illustrated in FIG. 25.
Figure 26:
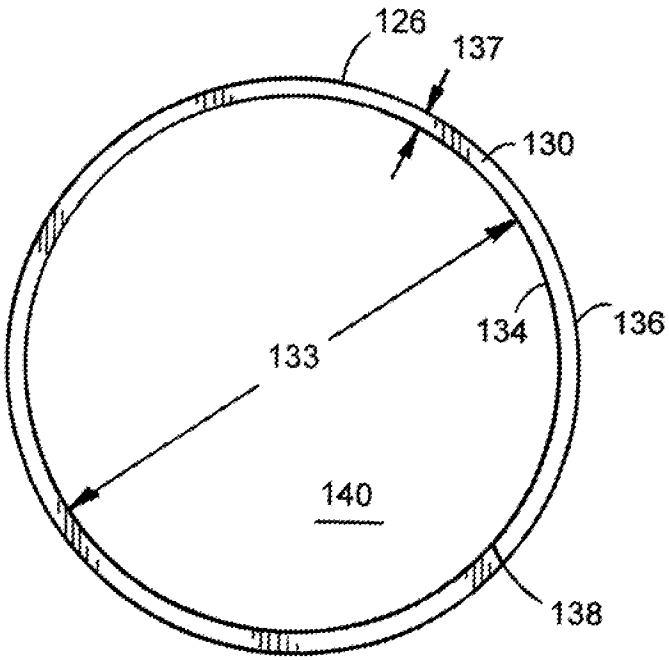
FIG. 26 is a front view of the handle outer ring illustrated in FIG. 25.
Figure 28:
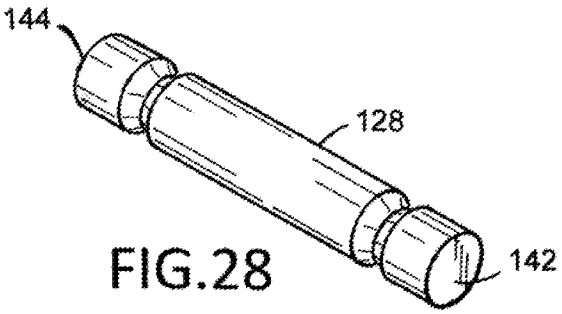
FIG. 28 is a perspective view of a handle shaft of a handle of the exercise apparatus illustrated in FIG. 1.
Figure 30:
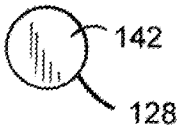
FIG. 30 is a side view of the handle shaft illustrated in FIG. 28.
Figure 32:
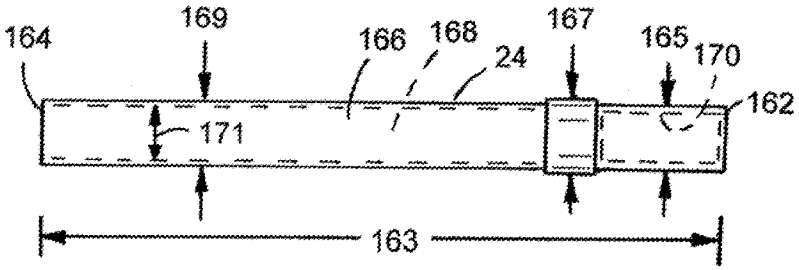
FIG. 32 is a front view of the third shaft of the exercise apparatus illustrated in FIG. 1.
Figure 29:
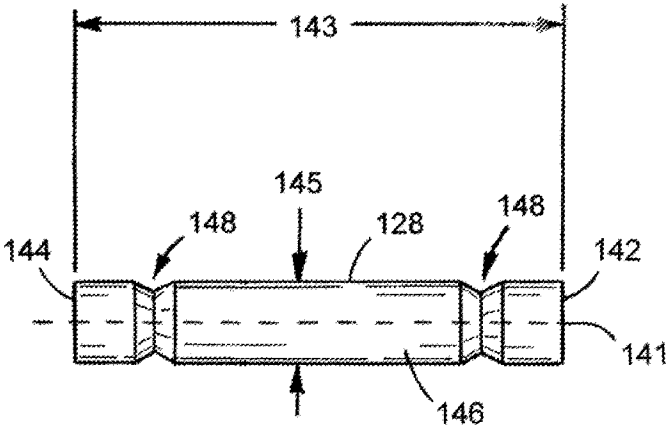
FIG. 29 is a front view of the handle shaft illustrated in FIG. 28.

In the illustrated embodiment, the first handle 16 is rotatably attached to the first frame 14 and extends across the first frame passageway 56 (e.g., entire first frame passageway 56) and the second handle 20 is rotatably attached to the second frame 18 and extends across the second frame passageway 56 (e.g., entire second frame passageway 56). Each of the first handle 16 and the second handle 20 includes a handle outer ring 126, as shown in FIGS. 25, 26, and 27, and a handle shaft 128, as shown in FIGS. 28, 29, and 30. The handle outer ring 126 is attached to the third inner ring 46 such that the handle 16, 20 is rotatably attached to a frame 14, 18 and has 360 degrees of rotation relative to the frame 14, 18. However, alternative embodiments can include handles that can only partially rotate relative to a frame (e.g., less than 360 degrees, between 45 degrees and 315 degrees) and/or that only partial extend across a frame passageway.

The handle outer ring 126 has a handle outer ring first surface 130, a handle outer ring second surface 132, a handle outer ring inner surface 134, a handle outer ring outer surface 136, a handle outer ring outside diameter 131 equal to about 6.38 inches, a handle outer ring inside diameter 133 equal to about 6.0 inches, a handle outer ring width 135 equal to about 0.84 inches, a handle ring thickness 137 equal to about 0.19 inches, and a handle outer ring main body 138 that defines a handle outer ring passageway 140. The handle outer ring passageway 140 extends from the handle outer ring first surface 130 to the handle outer ring second surface 132 and is sized and configured to receive the handle shaft 128. While the handle outer ring 126 has been illustrated as having a particular structural arrangement and as having various dimensions, a handle outer ring of an exercise apparatus can have any suitable structural arrangement and dimensions. Selection of suitable structural arrangement and dimensions for a handle outer ring can be based on various considerations, including the intended use of the exercise apparatus of which the handle outer ring is included.

The handle shaft 128 has a handle shaft lengthwise axis 141, a handle shaft first end 142, a handle shaft second end 144, a handle shaft length 143 that extends from the handle shaft first end 142 to the handle shaft second end 144, a handle shaft outside diameter 145, and a handle shaft main body 146 that defines handle shaft recesses 148. Each of the handle shaft first end 142 and the handle shaft second end 144 is attached to the handle outer ring 126. In the illustrated embodiment, the handle shaft length 143 is equal to about 6.0 inches and the handle shaft outside diameter 145 is equal to about 1.0 inch. However, alternative embodiments can have any suitable dimensions, such as a handle shaft outside diameter equal to about 1.19 inches. Each recess of the handle shaft recesses 148 extends from an outer surface of the handle shaft 128 and into the handle shaft main body 146. Each recess of the plurality of recesses 148 has a length along the handle shaft lengthwise axis 141 equal to about 0.50 inches, a depth equal to about 0.25 inches or about 0.125 inches, is disposed about 0.75 inches from an end of the handle shaft 128, extends about the entire circumference of the handle shaft 128, is tapered from the outer surface of the handle shaft 128 toward the handle shaft lengthwise axis 141. While the handle shaft 128 has been illustrated as having a particular structural arrangement and as having various dimensions, a handle shaft of an exercise apparatus can have any suitable structural arrangement and dimensions. Selection of suitable structural arrangement and dimensions for a handle shaft can be based on various considerations, including the intended use of the exercise apparatus of which the handle shaft is included.

Figure 31:
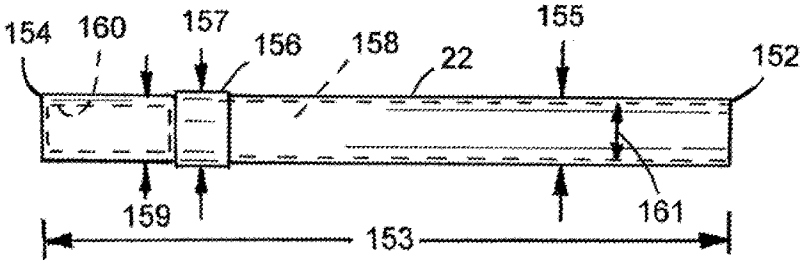
FIG. 31 is a front view of the second shaft of the exercise apparatus illustrated in FIG. 1.

In the illustrated embodiment, the second shaft 22 is releasably attached to the first frame 14 and is moveable along the length of an elongate member of the first frame 14, as described herein. The third shaft 24 is releasably attached to the second frame 18 and is moveable along the length of an elongate member of the second frame 18, as described herein. As best shown in FIG. 31, the second shaft 22 has a second shaft first end 152, a second shaft second end 154, a second shaft length 153 that extends from the second shaft first end 152 to the second shaft second end 154, a second shaft first outside diameter 155, a second shaft second outside diameter 157, a second shaft third outside diameter 159, and a second shaft main body 156 that defines a second shaft passageway 158 and second shaft threads 160. The second shaft length 153 is equal to about 21 inches. The second shaft passageway 158 extends from the second shaft first end 152 to the second shaft second end 154 and is sized and configured to receive a portion of the first frame 14 or a portion of the second frame 18. The second shaft passageway 158 has a second shaft passageway first inside diameter 161 that extends from the second shaft first end 152 toward the second shaft second end 154 a distance equal to about 17.0 inches. The second shaft first outside diameter 155 extends from the second shaft first end 152 toward the second shaft second end 154 a distance equal to about 15.38 inches and is equal to about 1.96 inches. The second shaft second outside diameter 157 (e.g., which forms a collar) extends from a portion of the second shaft 22 that has the second shaft first outside diameter 155 to a portion of the second shaft 22 that has the second shaft third outside diameter 159 a distance equal to about 1.62 inches and is equal to about 2.25 inches. The second shaft third outside diameter 159 extends from the second shaft second end 154 toward the second shaft first end 152 a distance equal to about 4.0 inches and is equal to about 2.0 inches. The second shaft main body 156 defines the second shaft threads 160 within the second shaft passageway 158 along a portion of the second shaft 22 that extends from the second shaft second end 154 toward the second shaft first end 152 a distance equal to about 4.0 inches. The second shaft thread 160 is a 1.50-5 LH ACME thread. The second shaft thread 160 is sized and configured to mate with the threads 112 of the first elongate member 50 or the threads 122 of the second elongate member 52. While the second shaft 22 has been illustrated as having a particular structural arrangement and as having various dimensions, a second shaft of an exercise apparatus can have any suitable structural arrangement and dimensions. Selection of suitable structural arrangement and dimensions for a second shaft can be based on various considerations, including the intended use of the exercise apparatus of which the second shaft is included.

The third shaft 24 has a third shaft first end 162, a third shaft second end 164, a third shaft length 163 that extends from the third shaft first end 162 to the third shaft second end 164, a third shaft first outside diameter 165, a third shaft second outside diameter 167, a third shaft third outside diameter 169, and a third shaft main body 166 that defines a third shaft passageway 168 and third shaft threads 170. The third shaft length 163 is equal to about 21 inches. The third shaft passageway 168 extends from the third shaft first end 162 to the third shaft second end 164 and is sized and configured to receive a portion of the second frame 18 or a portion of the first frame 14. The third shaft passageway 168 has a third shaft passageway first inside diameter 171 that extends from the third shaft second end 164 toward the third shaft first end 162 a distance equal to about 17.0 inches. The third shaft first outside diameter 165 extends from the third shaft first end 162 toward the third shaft second end 164 a distance equal to about 4.0 inches and is equal to about 2.0 inches. The third shaft second outside diameter 167 (e.g., which forms a collar) extends from a portion of the third shaft 24 that has the third shaft first outside diameter 165 to a portion of the third shaft 24 that has the third shaft third outside diameter 169 a distance equal to about 1.62 inches and is equal to about 2.25 inches. The third shaft third outside diameter 169 extends from the third shaft second end 164 toward the third shaft first end 162 a distance equal to about 15.38 inches and is equal to about 1.96 inches. The third shaft main body 166 defines the third shaft threads 170 within the third shaft passageway 168 along a portion of the third shaft 24 that extends from the third shaft first end 162 toward the third shaft second end 164 a distance equal to about 4.0 inches. The third shaft thread 170 is a 1.50-5 LH ACME thread. The third shaft thread 170 is sized and configured to mate with the threads 122 of the second elongate member 52 or the threads 112 of the first elongate member 50. While the third shaft 24 has been illustrated as having a particular structural arrangement and as having various dimensions, a third shaft of an exercise apparatus can have any suitable structural arrangement and dimensions. Selection of suitable structural arrangement and dimensions for a third shaft can be based on various considerations, including the intended use of the exercise apparatus of which the third shaft is included.

The exercise apparatuses described herein allow for customizing the distance between a first frame and a second frame and/or provide for rotation of the handles while using the exercise apparatus to relieve excessive stresses on the shoulders and surrounding soft tissues. For example, the exercise apparatuses described herein allow for a bench press maneuver to be performed in a more physiological motion in regards to shoulder joint mechanics as opposed to current exercise apparatuses (e.g., bench press bars that are fixed and don't allow for rotation, as described herein), which can diminish the risk of shoulder injury from excessive repetitions. The exercise apparatuses described herein can be used not only in standard weight training activities but also for shoulder and/or pectoral rehabilitation following non-surgical injuries and/or for rehabilitation following shoulder and/or pectoral ligament repair and/or reconstruction.

The first shaft 12, the first frame 14, the first handle 16, the second frame 18, the second handle 20, the second shaft 22, and the third shaft 24 included in an exercise apparatus 10 can be formed of any suitable material and manufactured using any suitable technique or method of manufacture. Selection of a suitable material and technique or method of manufacture can be based on various considerations, including the structural arrangement of the exercise apparatus of which the feature is a component. Examples of materials considered suitable to form a first shaft, a first frame, a first handle, a second frame, a second handle, a second shaft, and a third shaft include wood, polymers, plastics, metals, steel, stainless steel, aluminum, combinations of the materials described herein, and any other material considered suitable for a particular embodiment. Examples of techniques and methods of manufacture considered suitable to form a first shaft, a first frame, a first handle, a second frame, a second handle, a second shaft, and a third shaft include injection molding, casting, cold rolling, and any other technique or method considered suitable for a particular embodiment.

Any suitable technique or method of attaching the components described herein as being attached can be utilized and selection of a suitable technique or method can be based on various considerations, including the material that forms the components intended to be attached to one another. Examples of techniques and methods of attachment considered suitable between two components of an exercise apparatus include using snap-fit connections, using threaded connections, adhesives, fusing, welding, and any other technique or method considered suitable for a particular embodiment. Optionally, the exercise apparatus 10 can include one or more mechanical stops between the first shaft 12 and the first frame 14, the first shaft 12 and the second frame 18, the second shaft 22 and the first frame 14, and/or the third shaft 24 and the second frame 18. A mechanical stop can include any suitable structure and/or component capable of allowing a first component to interact with a second component such that they become releasably attached to one another but cannot be separated without user interaction, such as using a spring-loaded projection attached to the first component that becomes disposed within a recess defined by the second component.

While the first shaft 12, the first frame 14, the first handle 16, the second frame 18, the second handle 20, the second shaft 22, and the third shaft 24 have been illustrated as having a particular structural arrangement, a first shaft, a first frame, a first handle, a second frame, a second handle, a second shaft, and a third shaft included in an exercise apparatus can have any suitable structural arrangement and selection of suitable structural arrangement can be based on various considerations, including the intended use of the exercise apparatus. For example, an exercise apparatus can have a structural arrangement that allows for an Olympic sized bench press barbell to be positioned on a second shaft and/or a third shaft.

Figure 33:
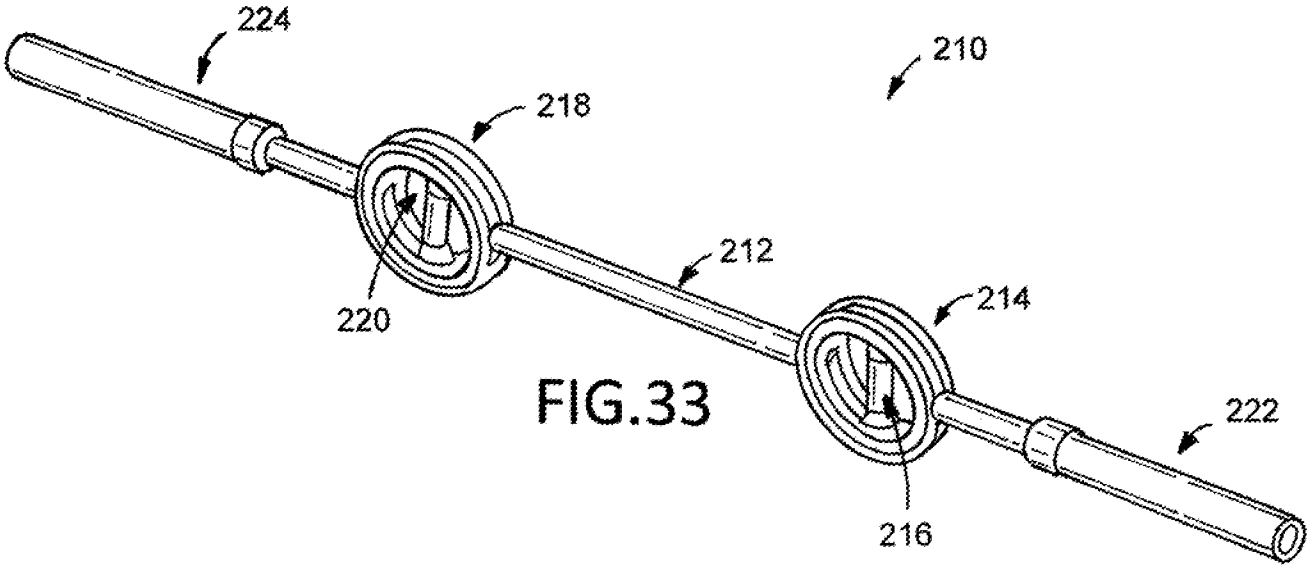
FIG. 33 is a perspective view of another example exercise apparatus.
Figure 34:
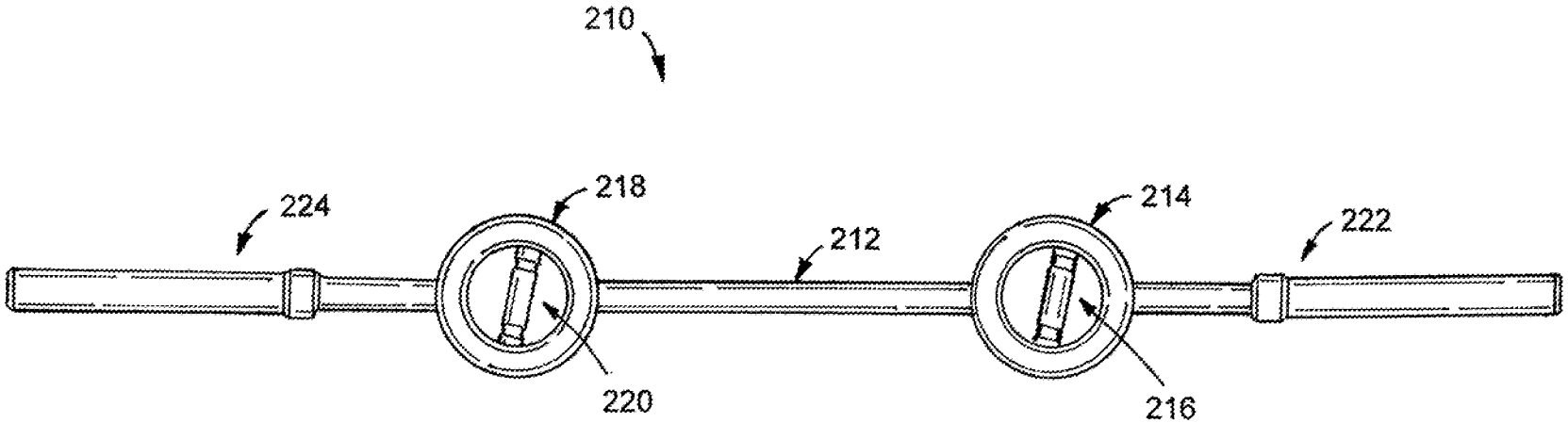
FIG. 34 is a front view of the exercise apparatus illustrated in FIG. 33.
Figure 35:
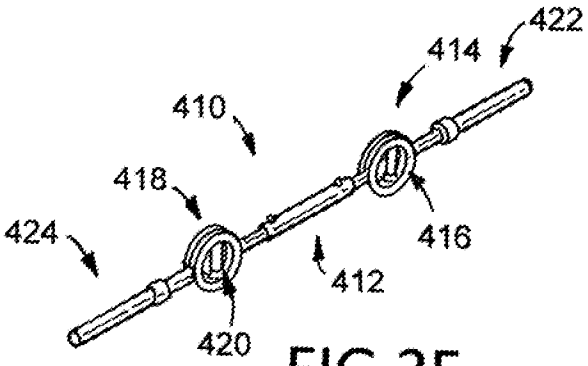
FIG. 35 is a perspective view of another example exercise apparatus.
Figure 37:
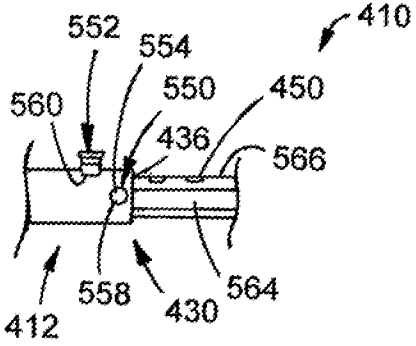
FIG. 37 is a magnified view of area 37-37 in FIG. 36.
Figure 36:
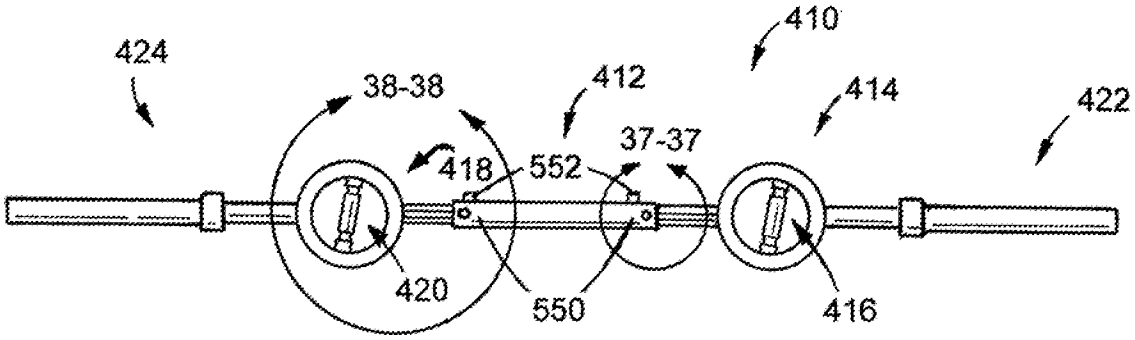
FIG. 36 is a front view of the exercise apparatus illustrated in FIG. 35.
Figure 38:
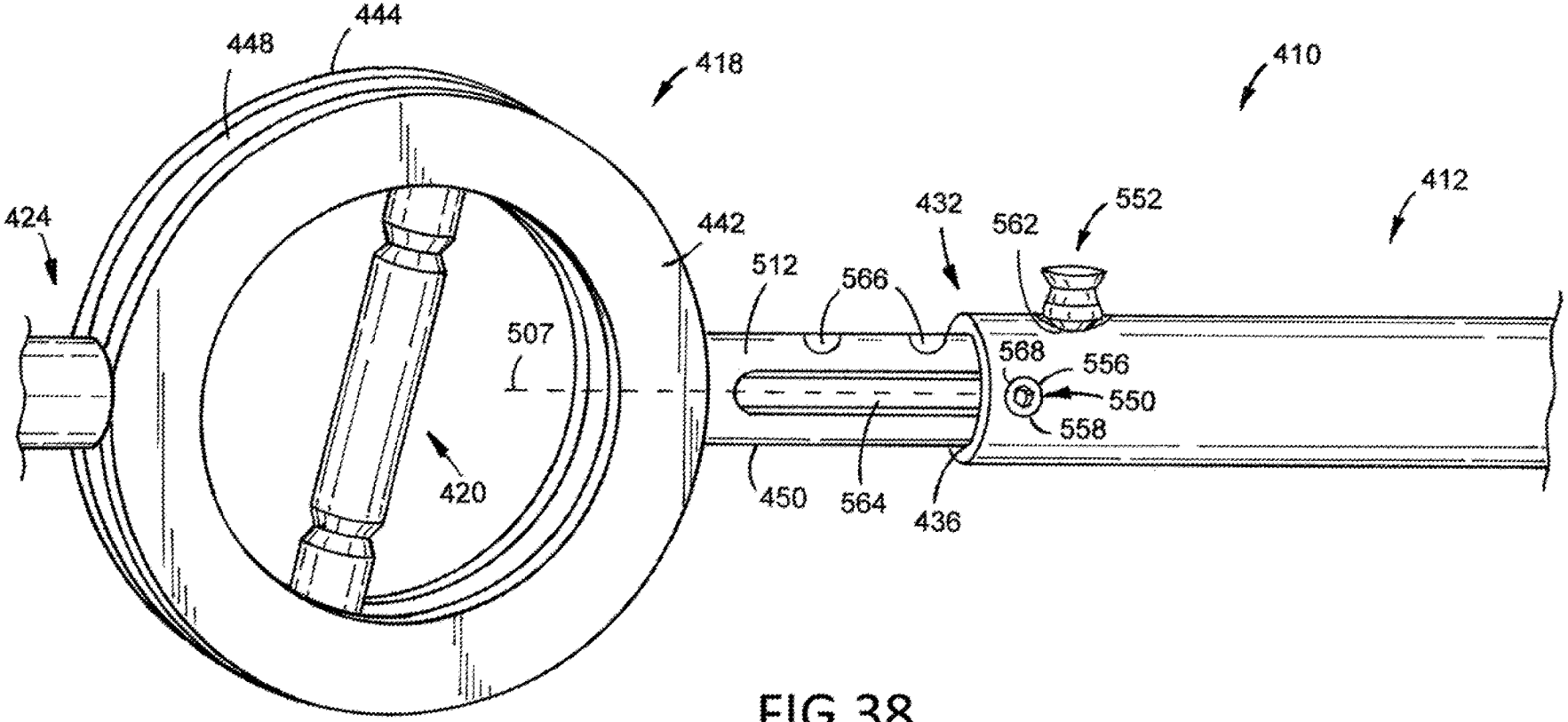
FIG. 38 is a magnified view of area 38-38 in FIG. 36.
Figure 39:
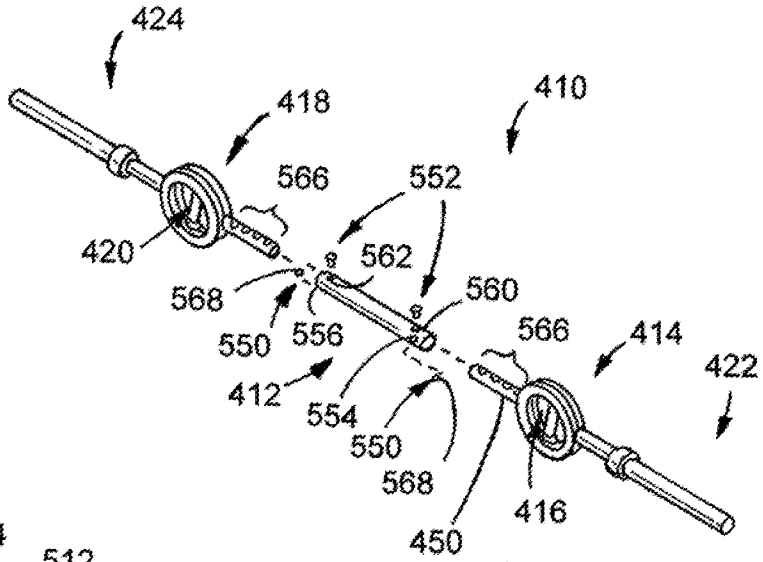
FIG. 39 is an exploded perspective view of the exercise apparatus illustrated in FIG. 35.
Figure 40:
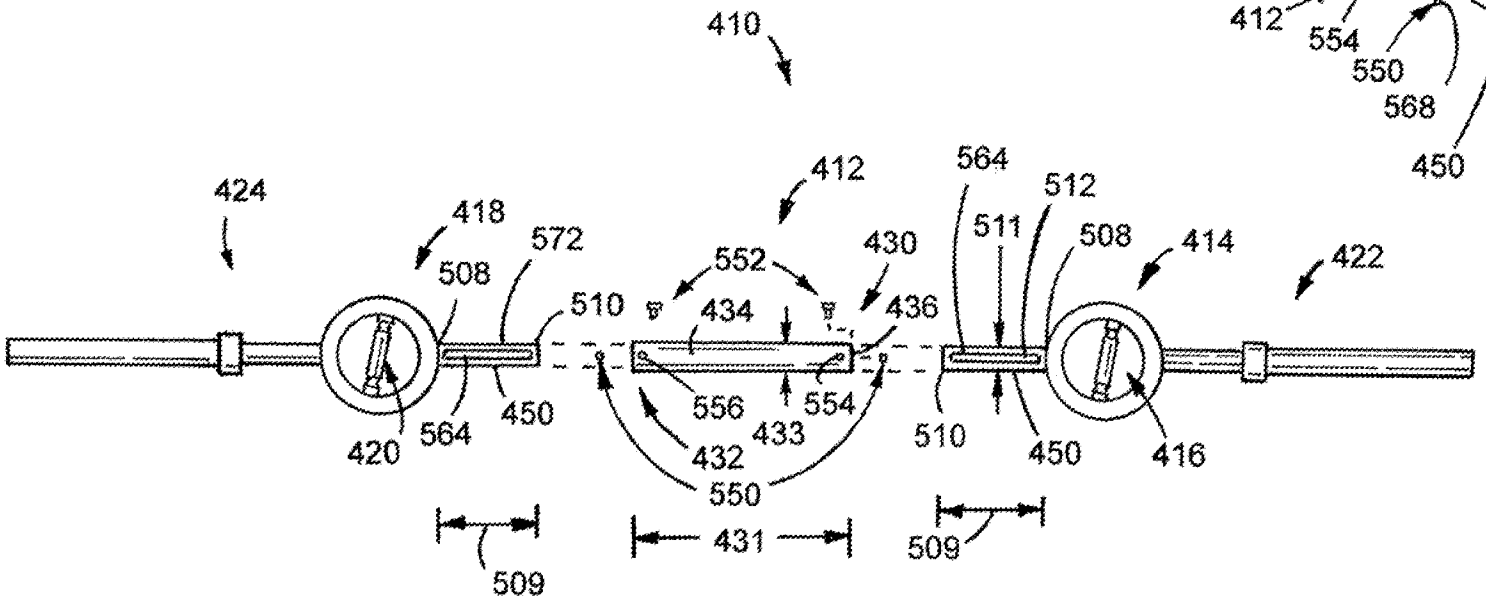
FIG. 40 is an exploded front view of the exercise apparatus illustrated in FIG. 35.

FIGS. 33 and 34 illustrate another example exercise apparatus 210. The exercise apparatus 210 is similar to the exercise apparatus 10 illustrated in FIGS. 1 through 32 and described above, except as detailed below. In the illustrated embodiment, the exercise apparatus 210 has a first shaft 212, a first frame 214, a first handle 216, a second frame 218, a second handle 220, a second shaft 222, and a third shaft 224.

In the illustrated embodiment, the first shaft 212 is fixedly attached to each of the first frame 214 and the second frame 218 such that the first shaft 212 cannot be separated from the first frame 214 or the second frame 218 without damaging the material that forms the first shaft 212. The second shaft 222 is fixedly attached to the first frame 214 such that the second shaft 222 cannot be separated from the first frame 214 without damaging the material that forms the second shaft 222. The third shaft 224 is fixedly attached to the second frame 218 such that the third shaft 224 cannot be separated from the second frame 218 without damaging the material that forms the third shaft 224. For example, the first shaft 212, the first frame 214, the second frame 218, the second shaft 222, and the third shaft 224 can be formed of the same materials and be directly attached to one another such that they are a unitary component.

FIGS. 35, 36, 37, 38, 39, and 40 illustrate another example exercise apparatus 410. The exercise apparatus 410 is similar to the exercise apparatus 10 illustrated in FIGS. 1 through 32 and described above, except as detailed below. In the illustrated embodiment, the exercise apparatus 410 has a first shaft 412, a first frame 414, a first handle 416, a second frame 418, a second handle 420, a second shaft 422, a third shaft 424, a plurality of set screws 550, and a plurality of locking pins 552.

In the illustrated embodiment, the first shaft 412 has a first shaft first end 430, a first shaft second end 432, a first shaft length 431 that extends from the first shaft first end 430 to the first shaft second end 432, a first shaft outside diameter 433, and a first shaft main body 434 that defines a first shaft first passageway 436, a first shaft second passageway 554, a first shaft third passageway 556, a plurality of threads 558, a first shaft fourth passageway 560, and a first shaft fifth passageway 562. The first shaft first passageway 436 extends from the first shaft first end 430 to the first shaft second end 432 and is sized and configured to receive a portion of the first frame 414 and the second frame 418. The first shaft passageway 436 has a first shaft passageway first inside diameter that extends from the first shaft first end 430 to the first shaft second end 432. Each of the first shaft second passageway 554 and the first shaft third passageway 556 extends through the first shaft main body 434, provides access to the first shaft first passageway 436, and is sized and configured to receive a set screw of the plurality of set screws 550. A thread of the plurality of threads 558 extends from the first shaft main body 434 into a passageway 554, 556 and is sized and configured to mate with a thread 568 defined by a set screw of the plurality of set screws 550, as described in more detail herein. Each of the first shaft fourth passageway 560 and the first shaft fifth passageway 562 extends through the first shaft main body 434, provides access to the first shaft passageway 436, and is sized and configured to receive a locking pin of the plurality of locking pins 552.

In the illustrated embodiment, each of the first frame 414 and the second frame 418 is releasable attached to the first shaft 412. The first frame 414 is attached to the first shaft first end 430 and the second frame 418 is attached to the first shaft second end 432. Each of the first frame 414 and the second frame 418 includes a first elongate member 450 and omits the inclusion of a second elongate member. The first elongate member 450 is attached to the first inner ring 442, the second inner ring 444, and the outer ring 448. The first elongate member 450 has a first elongate member lengthwise axis 507, a first elongate member first end 508, a first elongate member second end 510, a first elongate member length 509 that extends from the first elongate member first end 508 to the first elongate member second end 510, a first elongate member outside diameter 511, and a main body 512 that defines a first elongate member groove 564 and a first elongate member plurality of recesses 566. The first elongate member groove 564 extends into the first elongate member main body 512, is disposed between the elongate member first end 508 and the elongate member second end 510, and is sized and configured to receive a portion of a set screw of the plurality of set screws 550. Each of the first elongate member plurality of recesses 566 extends into the first elongate member main body 512, is disposed between the elongate member first end 508 and the elongate member second end 510, and is sized and configured to receive a portion of a locking pin of the plurality of locking pins 552.

In the illustrated embodiment, the second shaft 422 is fixedly attached to the first frame 414 such that the second shaft 422 cannot be separated from the first frame 414 without damaging the material that forms the second shaft 422 and the third shaft 424 is fixedly attached to the second frame 418 such that the third shaft 424 cannot be separated from the second frame 418 without damaging the material that forms the third shaft 424. Optionally, a second shaft and/or a third shaft can be formed of two separate components that are attached to one another. For example, a first component can comprise a component that is sized and configured to receive one or more plates and includes a collar for preventing movement of a plate toward the center of an exercise apparatus. A second component can comprise an elongate member that is sized and configured to be attached to the first component and a handle of an exercise apparatus. For example, a second component can be partially disposed within a recess defined by a first component (e.g., 2 inches) and attached to the first component (e.g., welding, fusing).

Each set screw of the plurality of set screws 550 (e.g., 0.50 inch set screw) is sized and configured to be received by a passageway 554, 556 defined by the first shaft main body 434 and a first elongate member groove 564. Each set screw of the plurality of set screws 550 defines a thread 568 that is sized and configured to mate with a thread of the plurality of threads 558 defined by the first shaft main body 434. Each set screw of the plurality of set screws 550 is movable between a first configuration in which the set screw is disposed within a passageway 554, 556 and is not disposed within a first elongate member groove 564 and a second configuration in which the set screw is disposed within a passageway 554, 556 and is disposed within a first elongate member groove 564. In the first configuration, the first shaft 412 is free of attachment to the handle and can be moved relative to the handle, or removed from the handle. In the second configuration, the set screw releasably attaches the first shaft 412 to the handle that defines the groove within which the set screw is disposed (e.g., the handle can be moved along the length of the groove 564). The inclusion of a first elongate member groove 564 and a plurality of set screws 550 provide a mechanism to manipulate the position of a handle relative to a first shaft such that an exercise apparatus can be customized to a desired lifting position and maintain the alignment and/or attachment between a first shaft and a handle.

Each locking pin of the plurality of locking pins 552 is sized and configured to be received by a passageway 560, 562 defined by the first shaft main body 434 and a first elongate member recess of the plurality of recesses 566. Each locking pin of the plurality of locking pins 552 is releasably attached to the first shaft 412 and is spring loaded such that it is biased toward the first shaft lengthwise axis. Each locking pin of the plurality of locking pins 552 is movable between a first configuration in which the locking pin is disposed within a passageway 560, 562 and is not disposed within a recess of the plurality of recesses 566 and a second configuration in which the locking pin is disposed within a passageway 560, 562 and is disposed within a recess of the plurality of recesses 566. In the first configuration, the first shaft 412 can be moved relative to the handle. In the second configuration, the locking pin releasably attaches the first shaft 412 to the handle that defines the recess within which the locking pin is disposed. The inclusion of a plurality of recesses 566 and a plurality of locking pins 552 provide a mechanism to manipulate the position of a handle relative to a first shaft (e.g., along the first shaft length) such that an exercise apparatus can be customized to a desired lifting position. In alternative embodiments, a frame and/or handle can be movable relative to a second shaft and/or third shaft. For example, in an embodiment, set screws and locking pins can provide for about 6 inches of adjustability of the handle length. Alternative embodiments, however, can provide different handle lengths, such as a handle length that is adjustable between about 1 inch to about 12 inches, between about 3 inches and about 9 inches, between about 5 inches and 7 inches, and any other width considered suitable for a particular embodiment.

In the illustrated embodiment, the exercise apparatus 410 has various lengths that can be adjusted according to a desired lifting position. For example, the exercise apparatus can have a total length that is adjustable between about 85.32 inches and about 96.31 inches, a length from the inside of the collar disposed on the second shaft to the inside of the collar disposed on the third shaft that is adjustable between about 52.32 inches and about 62.31 inches, a length from the outside of a first inner ring to the outside of a second inner ring that is adjustable between about 35.57 inches and about 46.57 inches, and a length from a first handle shaft to a second handle shaft that is adjustable between about 27.05 inches and about 38.03 inches. While particular lengths have been described, an exercise apparatus can have any suitable length and selection of a suitable length for an exercise apparatus can be based on various considerations, including the intended use of the exercise apparatus.

FIGS. 41 through 90 illustrate another example exercise apparatus 610. The exercise apparatus 610 is similar to the exercise apparatus 10 illustrated in FIGS. 1 through 32 and described above, except as detailed below. In the illustrated embodiment, the exercise apparatus 610 has a first shaft 612, a first frame 614, a first handle 616, a second frame 618, a second handle 620, a second shaft 622, and a third shaft 624, a plurality of set screws 750, and a plurality of plugs 752.

Figure 42:
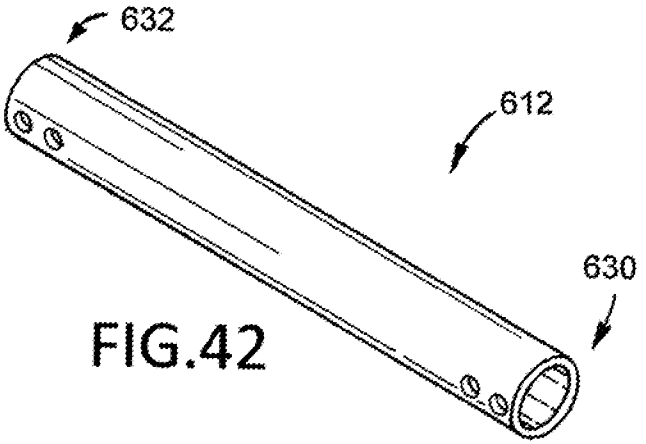
FIG. 42 is a perspective view of the first shaft of the exercise apparatus illustrated in FIG. 41.
Figure 44:
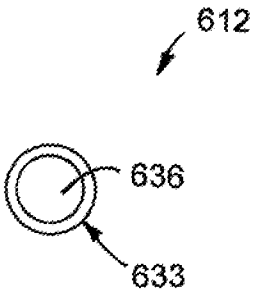
FIG. 44 is an end view of the first shaft illustrated in FIG. 42.
Figure 43:
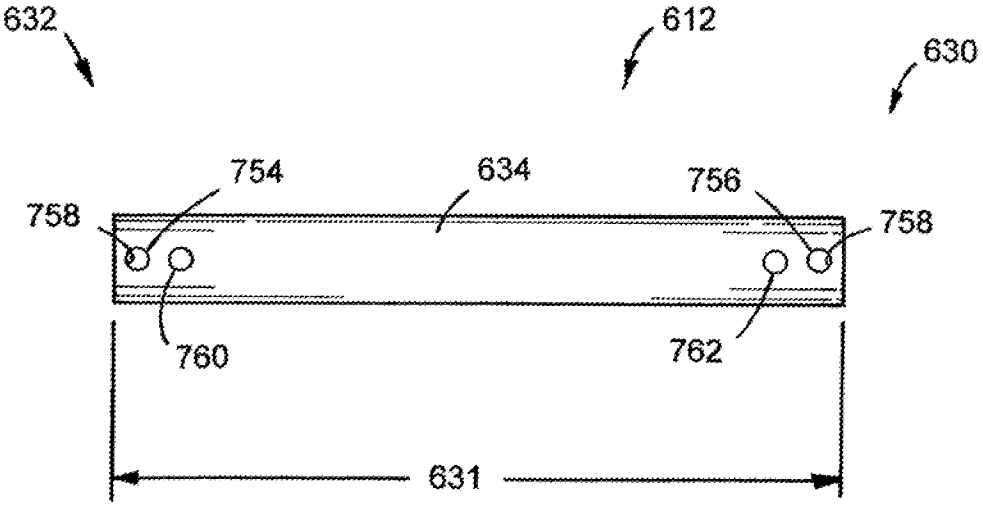
FIG. 43 is a front view of the first shaft illustrated in FIG. 42.

In the illustrated embodiment, and as best shown in FIGS. 42, 43, and 44, the first shaft 612 has a first shaft first end 630, a first shaft second end 632, a first shaft length 631 (e.g., 16.5 inches) that extends from the first shaft first end 630 to the first shaft second end 632, a first shaft outside diameter (e.g., 2.0 inches), and a first shaft main body 634 that defines a first shaft first passageway 636, a first shaft second passageway 754, a first shaft third passageway 756, a plurality of threads 758, a first shaft fourth passageway 760, and the first shaft fifth passageway 762. The first shaft first passageway 636 extends from the first shaft first end 630 to the first shaft second end 632 and is sized and configured to receive a portion of the first frame 614 and the second frame 618. The first shaft passageway 636 has a first shaft passageway first inside diameter (e.g., 1.6 inches) that extends from the first shaft first end 630 to the first shaft second end 632. Each of the first shaft second passageway 754 and the first shaft third passageway 756 extends through the first shaft main body 634, provides access to the first shaft first passageway 636, and is sized and configured to receive a set screw of the plurality of set screws 750. Each of the first shaft second passageway 754 and the first shaft third passageway 756 is disposed from an end of the first shaft 612 a distance (e.g., 0.50 inches) and has an inside diameter (e.g., 0.50 inches). A thread of the plurality of threads 758 extends from the first shaft main body 734 into a passageway 754, 756 and is sized and configured (e.g., ½-13 type thread) to mate with a thread 768 defined by a set screw of the plurality of set screws 750, as described in more detail herein. Each of the first shaft fourth passageway 760 and the first shaft fifth passageway 762 extends through the first shaft main body 634, provides access to the first shaft passageway 636, and is sized and configured to receive a plug of the plurality of plugs 752. Each of the first shaft fourth passageway 760 and the first shaft fifth passageway 762 is disposed from an end of the first shaft 612 a distance (e.g., 1.50 inches) and has an inside diameter (e.g., 0.53 inches).

In the illustrated embodiment, each of the first frame 614 and the second frame 618 is releasable attached to the first shaft 612. The first frame 614 is attached to the first shaft first end 630 and the second frame 618 is attached to the first shaft second end 632.

As best shown in FIGS. 45 through 77, each of the first frame 614 and the second frame 618 includes a first inner ring 642, a second inner ring 644, a plurality of tabs 766, a plurality of shafts 768, a first plurality of a plurality of wheels 770, a plurality of roller pins 772, a second plurality of wheels 774, a third inner ring 646, a fourth inner ring 647, an outer ring 648 attached to each of the first inner ring 642 and the second inner ring 644 such that each of the inner rings 642, 644 can move relative to the outer ring 648, a first cover 633, a second cover 635, a first elongate member 650, and defines a passageway 656.

In the illustrated embodiment, and as best shown in FIGS. 54, 55, 56, 57, and 58, each of the first inner ring 642 and the second inner ring 644 is a ring member that has an inner ring first surface 658, an inner ring second surface 660, an inner ring inner surface 662, an inner ring outer surface 664, an inner ring outside diameter 657 (e.g., 8.5 inches), an inner ring inside diameter 659 (e.g., 6.5 inches), an inner ring thickness 661 (e.g., 0.25 inches), and an inner ring main body 666 that defines a plurality of notches 776, a first plurality of passageways 778, and a second plurality of passageways 780. Each notch of the plurality of notches 776 extends from the inner ring outer surface 664 toward the inner ring inner surface 662 and has depth 767 (e.g., 0.21 inches) and a length 769 (e.g., 0.33 inches). A first set of notches of the plurality of notches 776 is offset by a first angle 771 (e.g., 60 degrees) and a second set of notches of the plurality of notches 776 is offset by a second angle 773 (e.g., 120 degrees). Each passageway of the first plurality of passageways 778 extends through the inner ring main body 666 from the inner ring first surface 658 to the inner ring second surface 660. Each passageway of the first plurality of passageways 778 is disposed a distance 775 (e.g., 0.38 inches) from a notch 776, has a length 777 (e.g., 0.33 inches), and a width 779 (e.g., 0.21 inches). A first set of passageways of the first plurality of passageways 778 is offset by a first angle 781 (e.g., 60 degrees) and a second set of passageways of the first plurality of passageways 778 is offset by a second angle 783 (e.g., 120 degrees). Each passageway of the second plurality of passageways 780 extends through the inner ring main body 666 from the inner ring first surface 658 to the inner ring second surface 660. Each passageway of the second plurality of passageways 780 is disposed a distance 785 (e.g., 0.16 inches) from the inner ring outer surface 664 and has an inside diameter 787 (e.g., 0.33 inches). Each passageway of the second plurality of passageways 780 is offset from an adjacent passageway of the second plurality of passageways by an angle 789 (e.g., 60 degrees) and an adjacent passageway of the first plurality of passageways by an angle 791 (e.g., 30 degrees).

Figure 59:
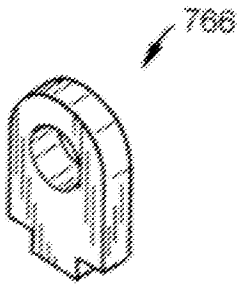
FIG. 59 is a perspective view of a tab of the exercise apparatus illustrated in FIG. 41.
Figure 61:
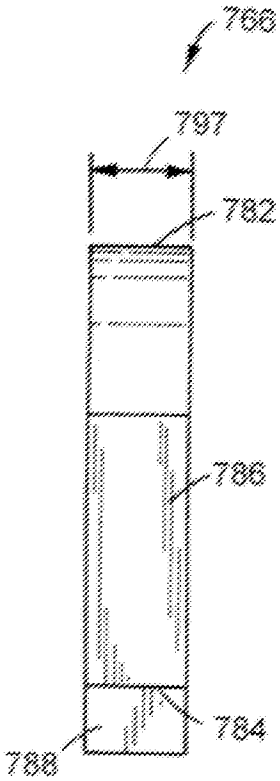
FIG. 61 is a side view of the tab illustrated in FIG. 59.
Figure 60:
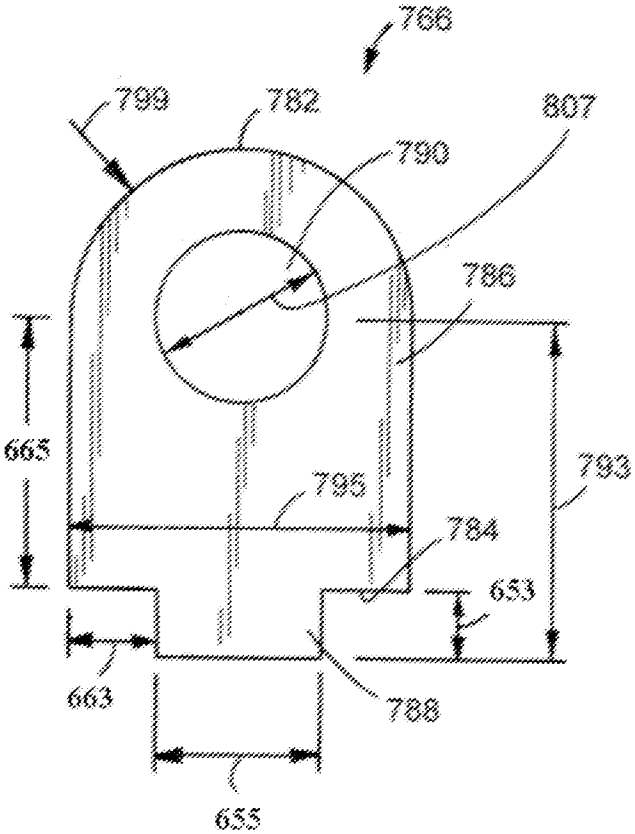
FIG. 60 is a front view of the tab illustrated in FIG. 59.

As best shown in FIGS. 59, 60, and 61 each tab of the plurality of tabs 766 has a first end 782, a second end 784, a height 793 (e.g., 0.94 inches), a width 795 (e.g., 0.63 inches), a thickness 797 (0.19 inches), and a main body 786 that defines a projection 788 and a passageway 790. The first end 782 has a radius of curvature 799 (e.g., 0.32 inches). The projection 788 extends from the second end 784 a distance 653 (e.g., 0.13 inches), is offset from a side of the tab a distance 663 (e.g., 0.16 inches), and has a width 655 (e.g., 0.31 inches). The passageway 790 extends through the main body 786, has an inside diameter 807 (e.g., 0.33 inches), is offset from a side of the tab a distance (e.g., 0.32 inches), and is offset from the second end a distance 665 (e.g., 0.5 inches). A tab in a first set of tabs of the plurality of tabs 766 is attached (e.g., welded) to an inner ring 642, 644 within the notches of the plurality of notches 776 and a tab in a second set of tabs of the plurality of tabs 766 is attached (e.g., welded) to an inner ring 642, 644 within the passageway of the first plurality of passageways 778.

Figure 62:
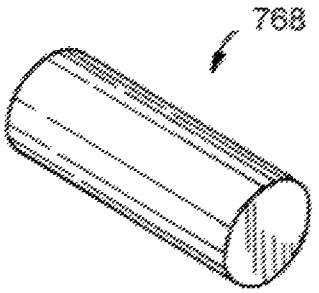
FIG. 62 is a perspective view of a shaft of the exercise apparatus illustrated in FIG. 41.
Figure 64:
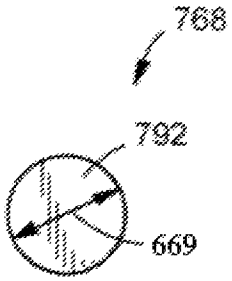
FIG. 64 is an end view of the shaft illustrated in FIG. 62.
Figure 63:
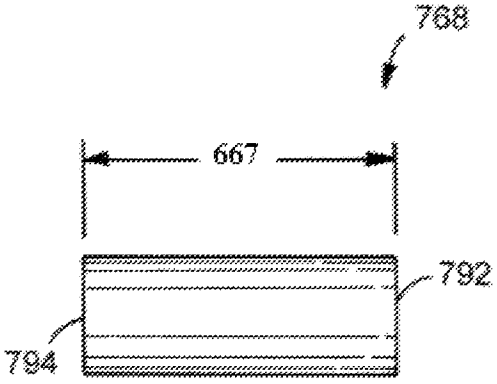
FIG. 63 is a front view of the shaft illustrated in FIG. 62.
Figure 65:
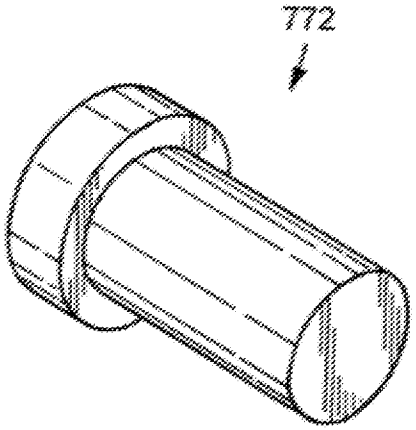
FIG. 65 is a perspective view of a roller pin of the exercise apparatus illustrated in FIG. 41.
Figure 67:
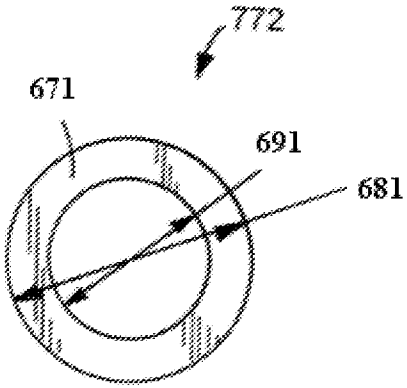
FIG. 67 is an end view of the roller pin illustrated in FIG. 65.
Figure 66:
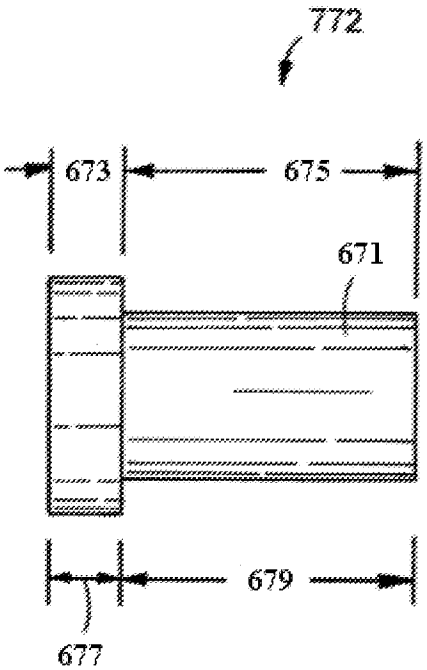
FIG. 66 is a front view of the roller pin illustrated in FIG. 65.

As best shown in FIGS. 62, 63, and 64, each shaft of the plurality of shafts 768 has a first end 792, a second end 794, a length 667 (e.g., 0.75 inches), and an outside diameter 669 (e.g., 0.28 inches). The first end 792 is attached (e.g., welded) within a passageway of a tab in the first set of tabs of the plurality of tabs 766 attached to an inner ring 642, 644 within the notches of the plurality of notches 776 and the second end 794 is attached (e.g., welded) within a passageway of a tab in the second set of tabs of the plurality of tabs 766 attached to an inner ring 642, 644 within the passageways of the first plurality of passageways 778.

Figure 51:
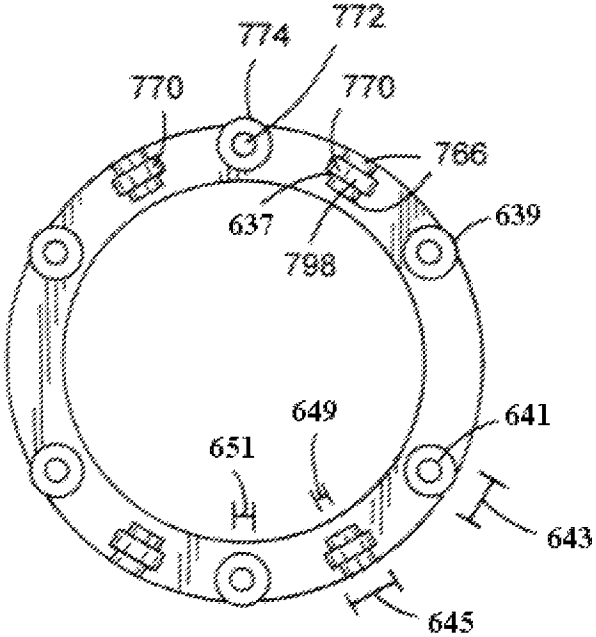
FIG. 51 is a front view of the portion of the frame illustrated in FIG. 50.
Figure 52:
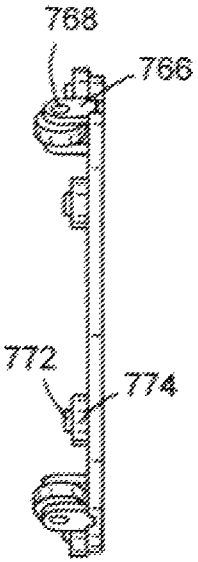
FIG. 52 is side view of the portion of the frame illustrated in FIG. 50.
Figure 53:
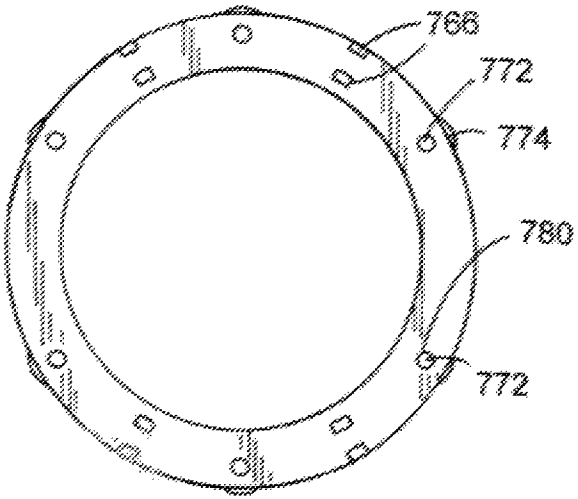
FIG. 53 is a rear view of the portion of the frame illustrated in FIG. 50.
Figure 54:
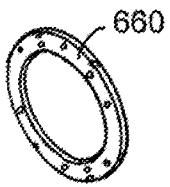
FIG. 54 is a perspective view of an inner ring of the exercise apparatus illustrated in FIG. 41.
Figure 58:
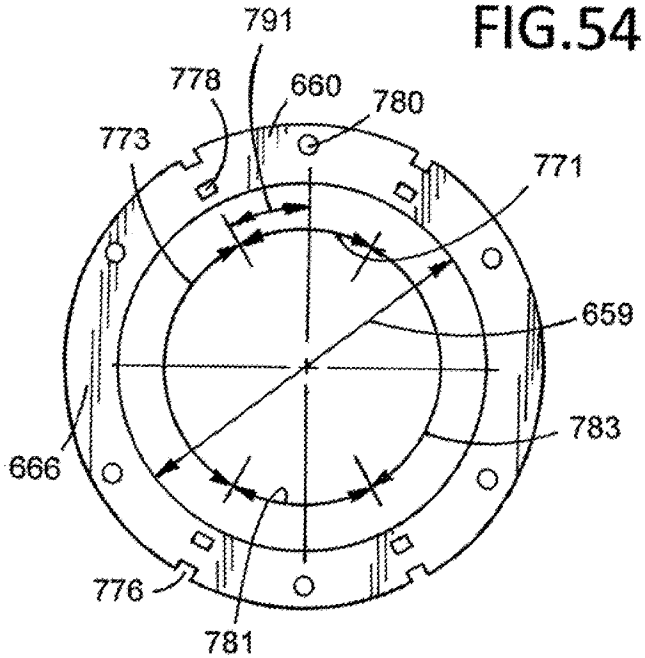
FIG. 58 is a rear view of the inner ring illustrated in FIG. 54.
Figure 57:
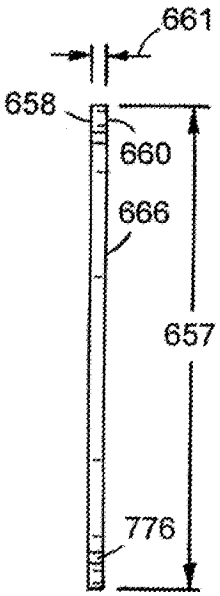
FIG. 57 is an end view of the inner ring illustrated in FIG. 54.
Figure 55:
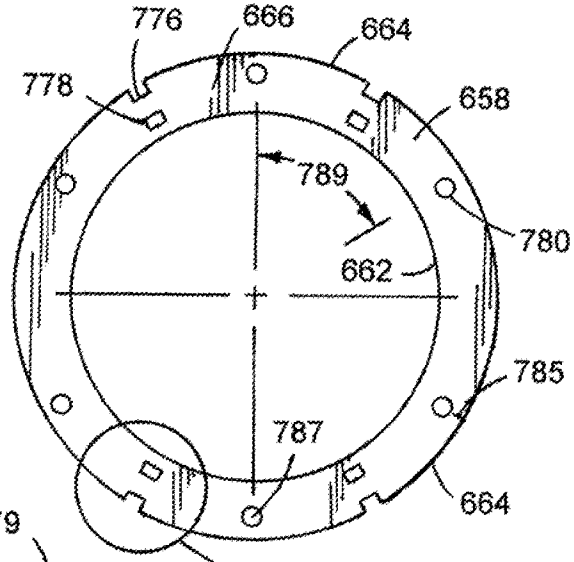
FIG. 55 is a front view of the inner ring illustrated in FIG. 54.
Figure 56:
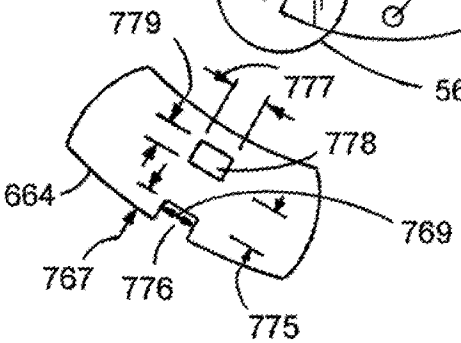
FIG. 56 is a magnified view of area 56-56 in FIG. 55.

As best shown in FIG. 51, a wheel in the first plurality of wheels 770 is rotatably disposed on each shaft of the plurality of shafts 768. Each wheel in the first plurality of wheels 770 has a main body 798 that defines a passageway 637, an outside diameter 645, and an inside diameter 649. The outside diameter is greater than the radius of curvature 799 (e.g., 0.32 inches) of the first end 782 of each tab of the plurality of tabs 766. The inside diameter 649 is sized and configured to receive a portion of a shaft of the plurality of shafts 768 and is less than the radius of curvature 799 (e.g., 0.32 inches) of the first end 782 of each tab of the plurality of tabs 766.

As best shown in FIGS. 51, 52, 65, 66, and 67, a roller pin of the plurality of roller pins 772 is attached (e.g., welded) within each passageway of the second plurality of passageways 780. Each roller pin of the plurality of roller pins 772 has a main body 671 that defines a first portion 677 and a second portion 679. The first portion 677 has a length 673 (e.g., 0.13 inches) and an outside diameter 681 (e.g., 0.40 inches). The second portion 679 has a length 675 (e.g., 0.63 inches) and an outside diameter 691 (e.g., 0.28 inches) and is partially disposed within a passageway of the second plurality of passageways 780.

As best shown in FIG. 51, a wheel in the second plurality of a plurality of wheels 774 is rotatably disposed on each roller pin of the plurality of roller pins 772. Each wheel in the second plurality wheels 774 has a main body 639 that defines a passageway 641, an outside diameter 643 (e.g., 0.65 inches), and an inside diameter 651. The outside diameter 643 is sized and configured such that each wheel in the second plurality of wheels 774 can contact the inner surface 700 of the outer ring 648. The inside diameter 651 is sized and configured to receive a portion of the second portion 679 of a roller pin of the plurality of roller pins 772 and is less than the outside diameter 681 of the first portion 677 of a roller pin of the plurality of roller pins 772.

Figure 45:
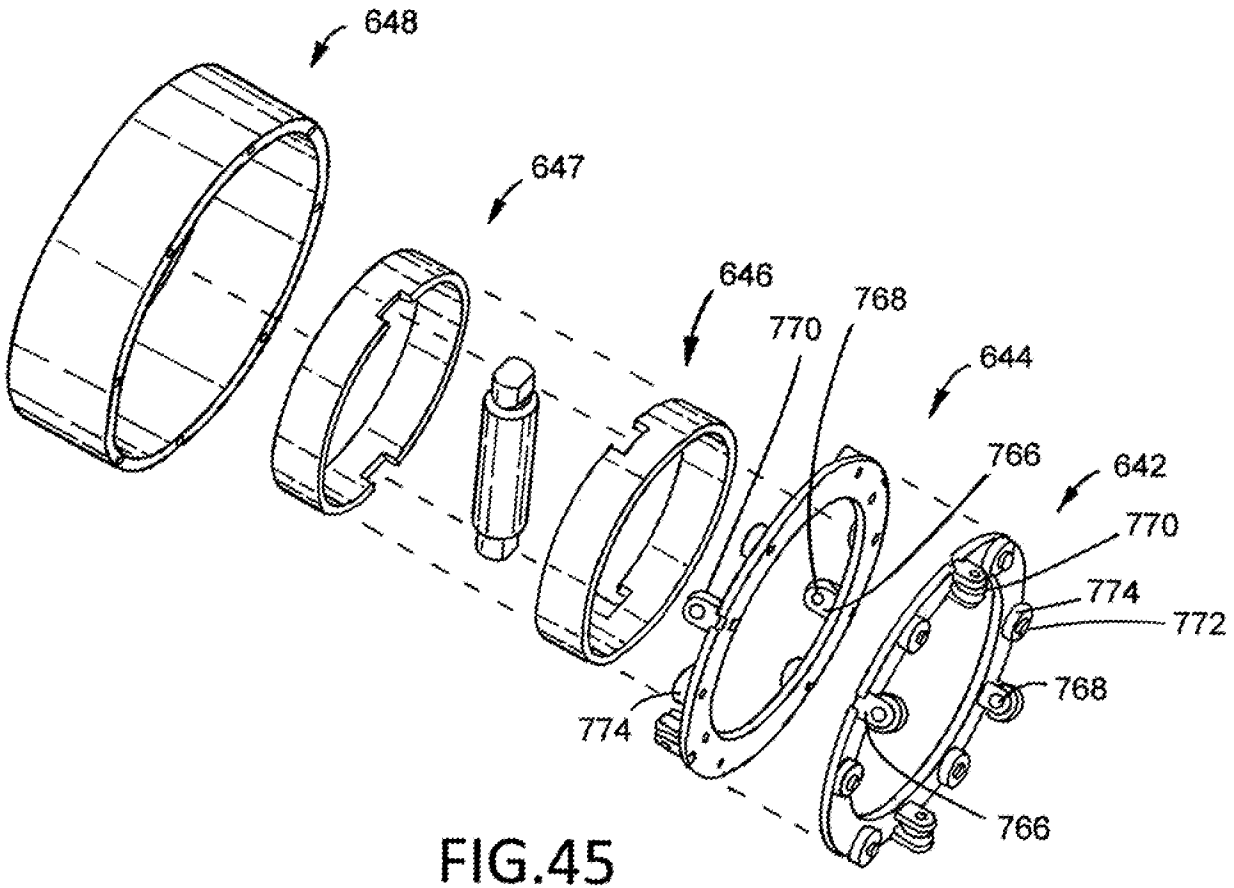
FIG. 45 is an exploded view of a frame and a handle of the exercise apparatus illustrated in FIG. 41.
Figure 48:
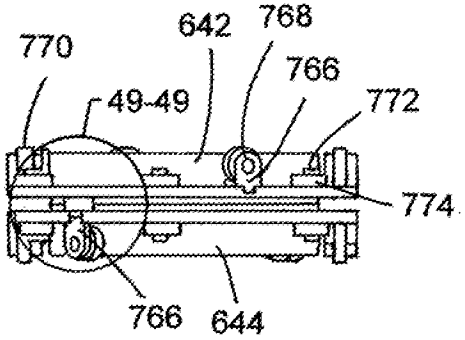
FIG. 48 is another side view of the portion of the frame and handle illustrated in FIG. 46.
Figure 49:
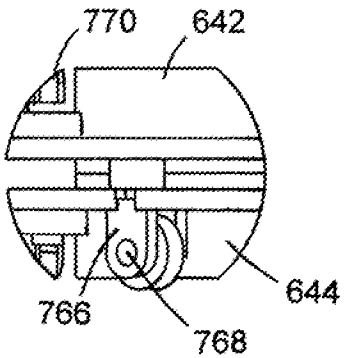
FIG. 49 is a magnified view of area 49-49 in FIG. 48.
Figure 46:
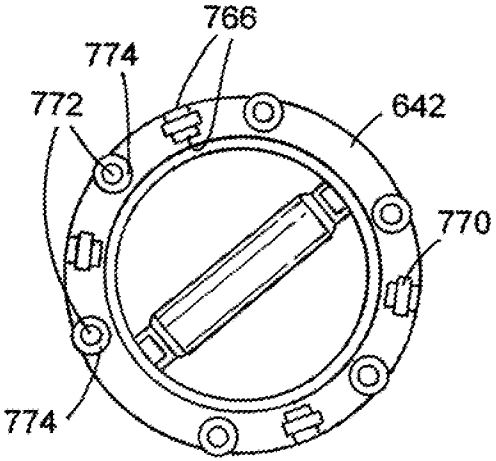
FIG. 46 is a front view of a portion of a frame and a handle of the exercise apparatus illustrated in FIG. 41.
Figure 47:
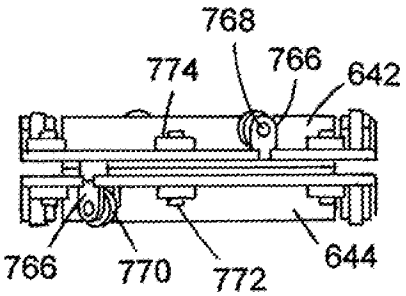
FIG. 47 is a side view of the portion of the frame and handle illustrated in FIG. 46.
Figure 50:
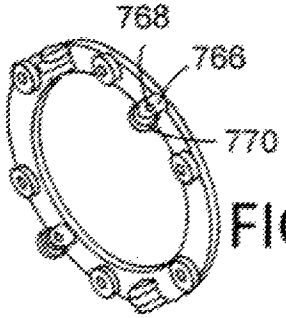
FIG. 50 a perspective view of a portion of a frame of the exercise apparatus illustrated in FIG. 41.
Figure 68:
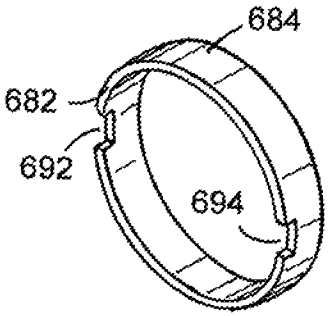
FIG. 68 is a perspective view of another inner ring of the exercise apparatus illustrated in FIG. 41.
Figure 70:
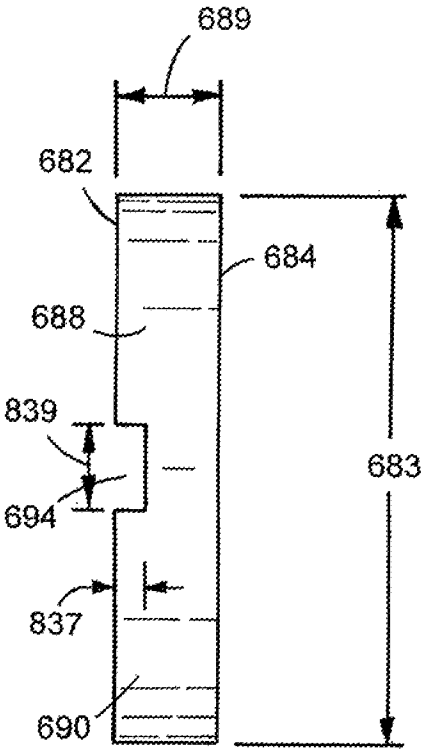
FIG. 70 is a side view of the inner ring illustrated in FIG. 68.
Figure 69:
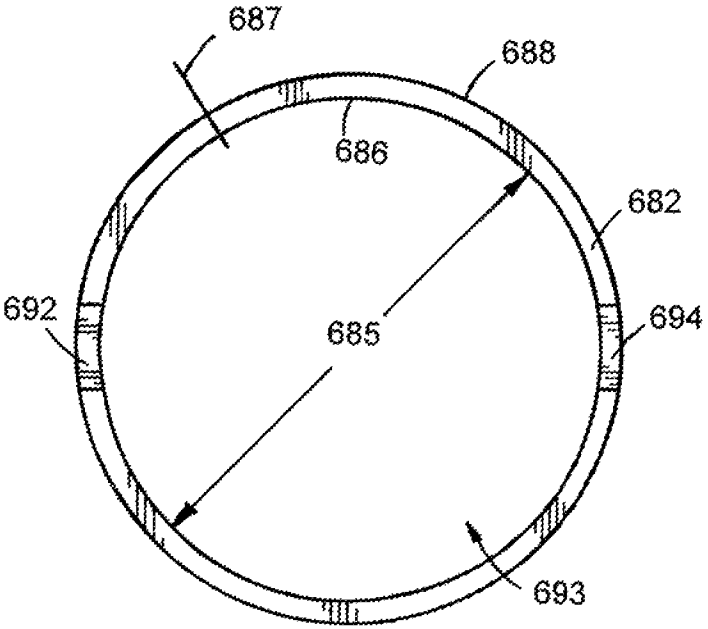
FIG. 69 is a front view of the inner ring illustrated in FIG. 68.
Figure 71:
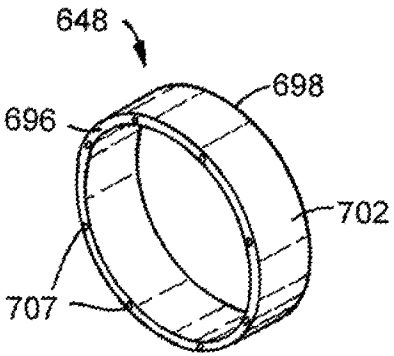
FIG. 71 is a perspective view of an outer ring of the exercise apparatus illustrated in FIG. 41.
Figure 74:
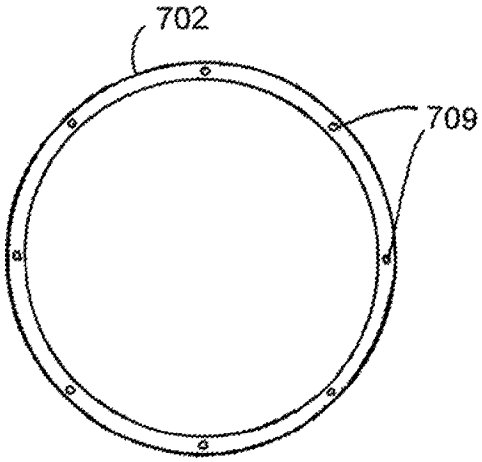
FIG. 74 is a rear view of the outer ring illustrated in FIG. 71.
Figure 73:
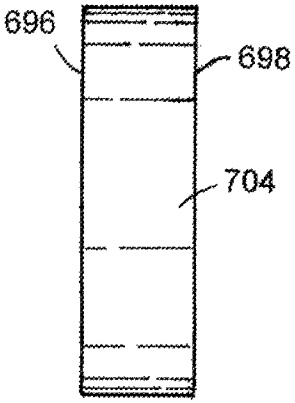
FIG. 73 is a side view of the outer ring illustrated in FIG. 71.
Figure 72:
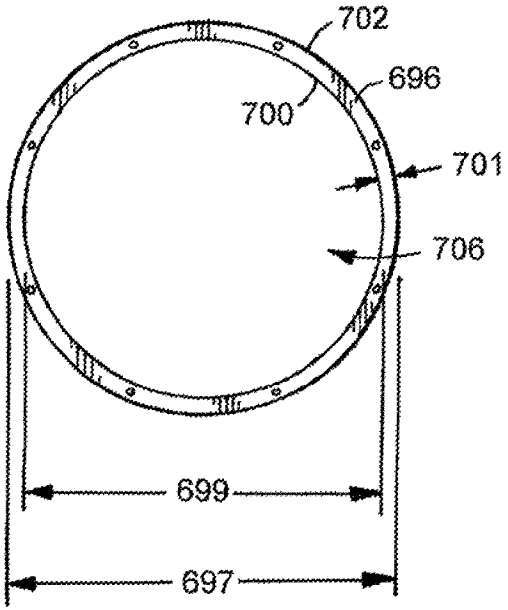
FIG. 72 is a front view of the outer ring illustrated in FIG. 71.

As shown in FIG. 45, the third inner ring 646 is attached (e.g., welded) to the first inner ring 642 and the fourth inner ring 647 is attached (e.g., welded) to the second inner ring 644. As best shown in FIGS. 68, 69, and 70, each of the third inner ring 646 and the fourth inner ring 647 has a first surface 682, a second surface 684, an inner surface 686, an outer surface 688, an outside diameter 683 (e.g., 6.5 inches), an inside diameter 685 (e.g., 6 inches), a thickness 687 (e.g., 0.25 inches), a length 689 (e.g., 1.25 inches), and a main body 690 that defines a passageway 693, a first notch 692, and a second notch 694. Each of the first notch 692 and the second notch 694 extends from the first surface 682 toward the second surface 684, is sized and configured to receive a portion of a handle 616, 620, and has a depth 837 (e.g., 0.4 inches) and a length 839 (e.g., 1.10 inches).

In the illustrated embodiment, as shown best in FIGS. 71, 72, 73, and 74, the outer ring 648 has an outer ring first surface 696, an outer ring second surface 698, an outer ring inner surface 700, an outer ring outer surface 702, an outer ring outside diameter 697 (e.g., 9.5 inches), an outer ring inside diameter 699 (e.g., 8.75 inches), an outer ring thickness 701, and an outer ring main body 704 that defines an outer ring passageway 706, a first plurality of recesses 707, and a second plurality of recesses 709. The outer ring passageway 706 extends from the outer ring first surface 696 to the outer ring second surface 698 (e.g., 2.75 inches) and is sized and configured to receive a portion of the first inner ring 642, the second inner ring 644, the third inner ring 646, and the fourth inner ring 647. Each recess of the first plurality of recesses 707 extends from the first surface 696 toward the second surface 698 and is sized and configured to receive a fastener to fasten the first cover 633 to the outer ring 648. Each recess of the second plurality of recesses 709 extends from the second surface 698 toward the first surface 696 and is sized and configured to receive a fastener to fasten the second cover 635 to the outer ring 648. Each recess in the first plurality of recesses 707 and in the second plurality of recesses 709 is offset from an adjacent recess by an angle (e.g., 45 degrees) and can have any suitable structural configuration (e.g., ¼-20 type thread with a 1.0 inch depth). When a frame is assembled, each of the first inner ring 642 and the second inner ring 644 is moveable relative to the outer ring 648.

Figure 75:
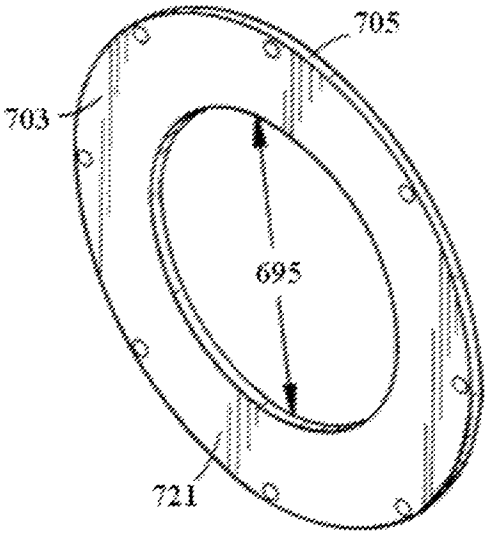
FIG. 75 is a perspective view of a cover of the exercise apparatus illustrated in FIG. 41.
Figure 77:
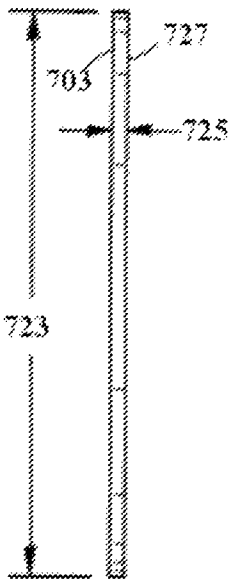
FIG. 77 is a side view of the cover illustrated in FIG. 75.
Figure 76:
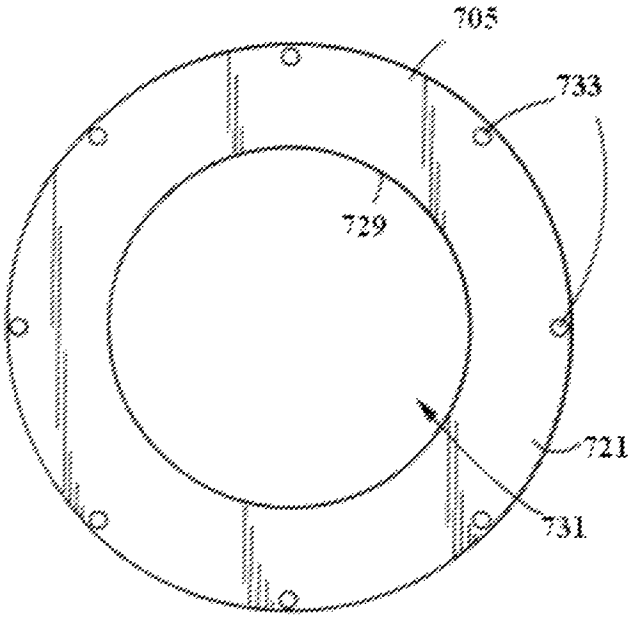
FIG. 76 is a front view of the cover illustrated in FIG. 75.

As shown in FIGS. 75, 76, and 77, each of the first cover 633 and the second cover 635 has a first surface 703, a second surface 727, an inner surface 729, an outer surface 705, an outside diameter 723 (e.g., 9.5 inches), an inside diameter 695 (e.g., 6 inches), a thickness 725 (e.g., 0.25 inches), and a main body 721 that defines a main passageway 731 and a plurality of passageways 733. The main passageway 731 extends from the first surface 703 to the second surface 727. Each passageway of the plurality of passageways 733 extends through the main body 721 from the first surface 703 to the second surface 727 and is sized and configured to receive a fastener to fasten the cover 633, 635 to the outer ring 648. Each passageway of the plurality of passageways 733 is offset from an adjacent recess by an angle (e.g., 45 degrees) and can have any suitable structural configuration (e.g., 0.31 inch inside diameter). When assembled, as shown in FIG. 41, the first cover 633 is attached to the outer ring first surface 696 and the second cover 635 is attached to the outer ring second surface 698.

Figure 41:
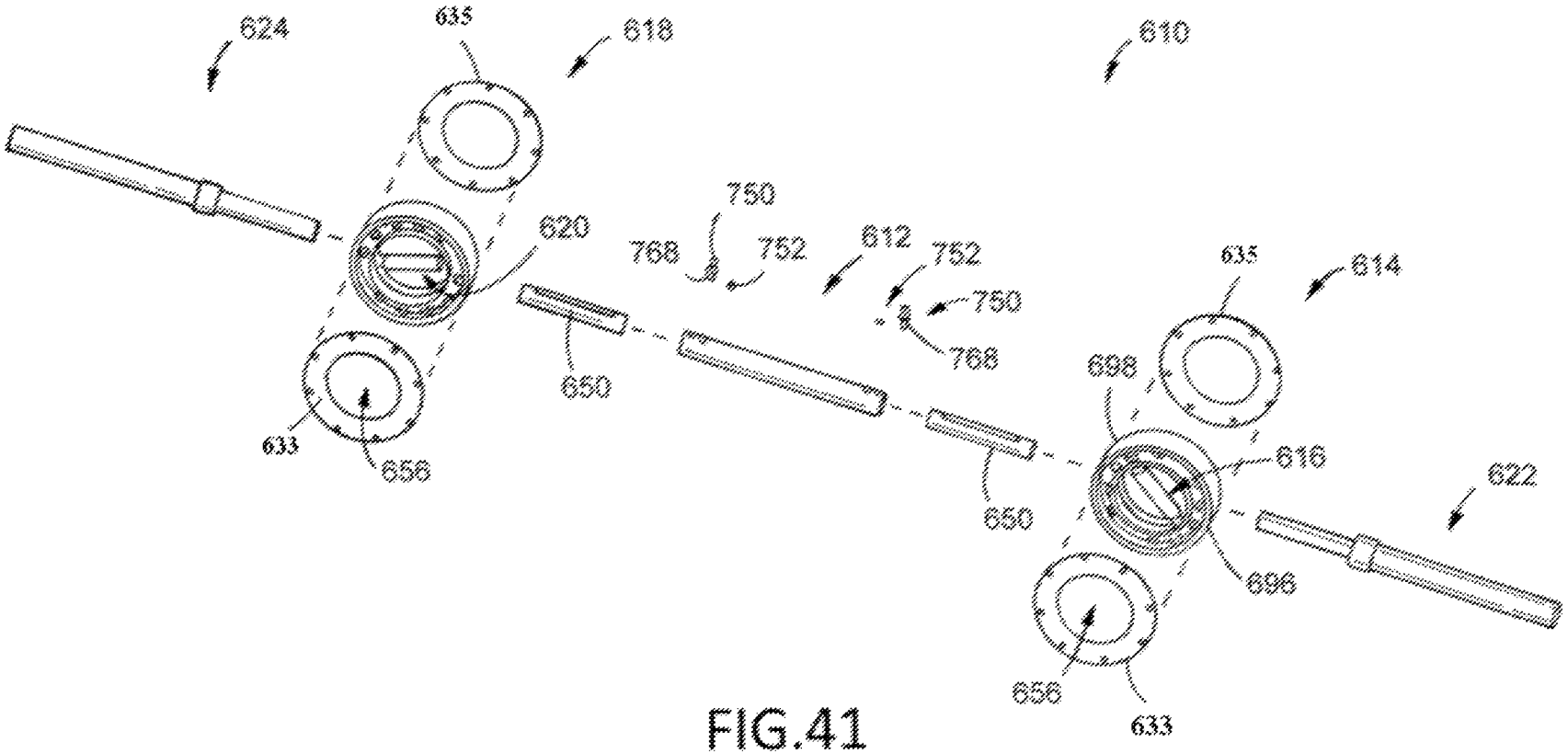
FIG. 41 is an exploded perspective view of another example exercise apparatus.
Figure 78:
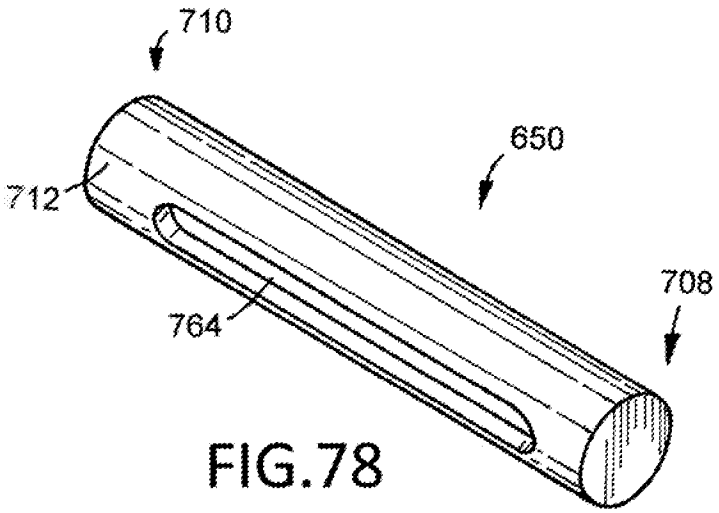
FIG. 78 is a perspective view of a first elongate member of the exercise apparatus illustrated in FIG. 41.
Figure 80:
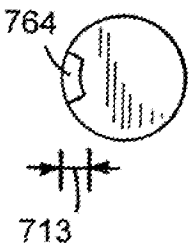
FIG. 80 is an end view of the elongate member illustrated in FIG. 78.
Figure 79:
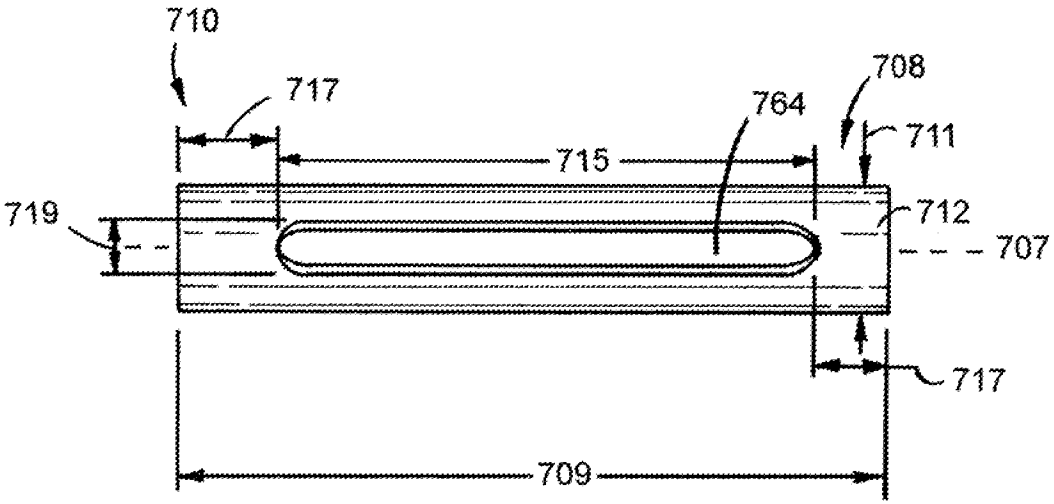
FIG. 79 is a front view of the elongate member illustrated in FIG. 78.
Figure 81:
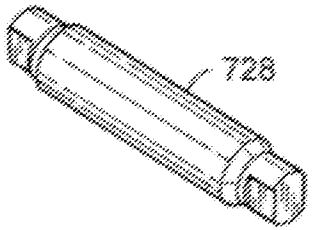
FIG. 81 is a perspective view of a handle of the exercise apparatus illustrated in FIG. 41.
Figure 82:
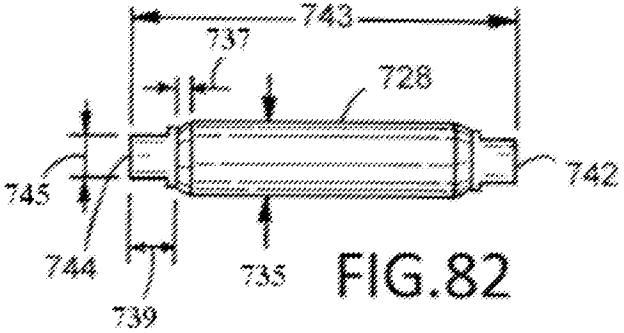
FIG. 82 is a top view of the handle illustrated in FIG. 81.
Figure 84:
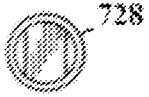
FIG. 84 is an end view of the handle illustrated in FIG. 81.
Figure 83:
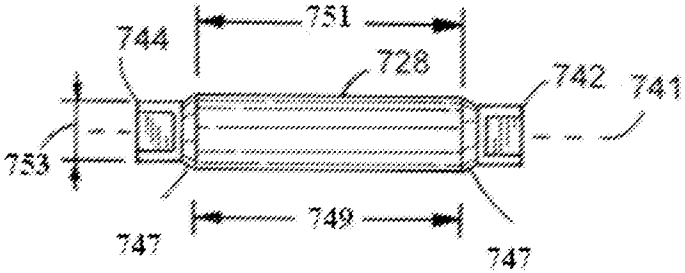
FIG. 83 is a front view of the handle illustrated in FIG. 81.

As shown in FIG. 41, the first elongate member 650 is attached to the outer ring 648 (e.g., welded). As shown in FIGS. 78, 79, and 80, the first elongate member 650 has a first elongate member lengthwise axis 707, a first elongate member first end 708 attached to the outer ring 648, a first elongate member second end 710, a first elongate member length 709 (e.g., 8.5 inches) that extends from the first elongate member first end 708 to the first elongate member second end 710, a first elongate member outside diameter 711 (e.g., 1.5 inches), and a main body 712 that defines a first elongate member groove 764. The first elongate member groove 764 extends into the first elongate member main body 712, is disposed between the elongate member first end 708 and the elongate member second end 710, and is sized and configured to receive a portion of a set screw of the plurality of set screws 750 and a portion of a plug 752. The first elongate member groove 764 has a depth 713 (e.g., 0.25 inches), a length 715 (e.g., 6.43 inches), is disposed from an end 708, 710 a distance 717 (e.g., between about 0.80 inches and about 1.2 inches), and has a width 719 (e.g., 0.61 inches). The first elongate member 650 is sized and configured to be received by the first shaft first passageway 636.

As shown in FIGS. 41 and 45, the first handle 616 is attached to the third inner ring 646 and the fourth inner ring 647 within notches 692, 694 and extends across the passageway 656 and the second handle 620 is attached to the third inner ring 646 and the fourth inner ring 647 within notches 692, 694 and extends across the passageway 656. As shown in FIGS. 81, 82, 83, and 84, each of the first handle 616 and the second handle 620 has a handle shaft 728. The handle shaft 728 has a lengthwise axis 741, a first end 742, a second end 744, a length 743 that extends from the first end 742 to the second end 744 (e.g., 6.5 inches), a first outside diameter 735 (e.g., 1.25 inches), first and second tapered portions 747 that have lengths 737 (e.g., 0.25 inches), a central portion 749 (e.g., knurled) that has a length 751 (e.g., 4.5 inches), a second outside diameter 753 (e.g., 1 inch) that is less than the first outside diameter 735, and a width 745 (e.g., 0.75 inches) along each of the ends 742, 744 that extends along a portion 739 (e.g., 0.63 inches) of the length 751 and is sized and configured to be disposed within the notches 692, 692 defined by the inner rings 646, 647.

Figure 85:
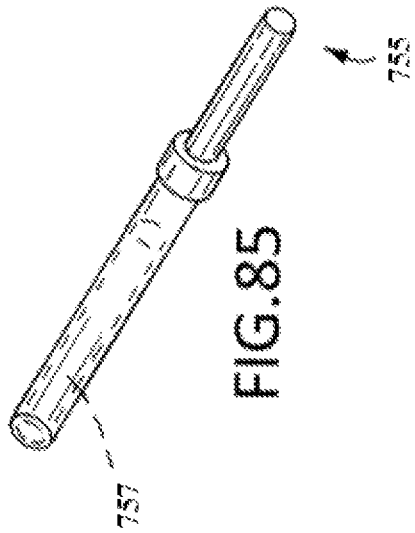
FIG. 85 is a perspective view of another elongate member of the exercise apparatus illustrated in FIG. 41.
Figure 87:
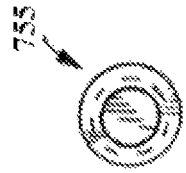
FIG. 87 is an end view of the elongate member illustrated in FIG. 85.
Figure 86:
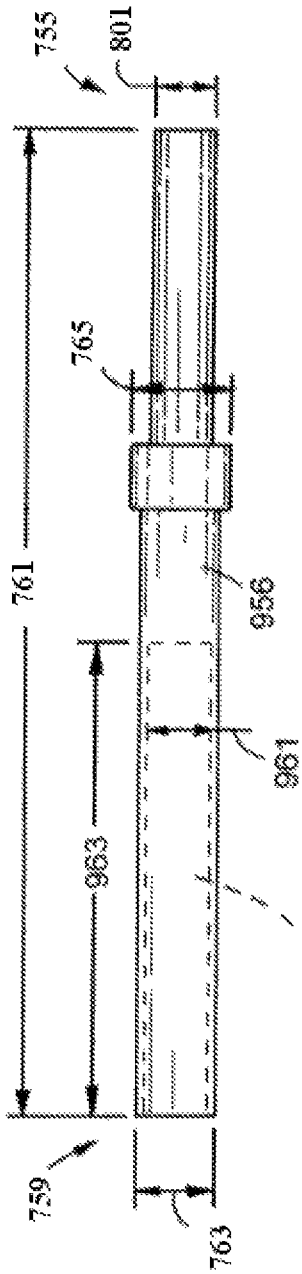
FIG. 86 is a front view of the elongate member illustrated in FIG. 85.

In the illustrated embodiment, and as shown in FIG. 41, the second shaft 622 is fixedly attached to the first frame 614 (e.g., outer ring 648) such that the second shaft 622 cannot be separated from the first frame 614 without damaging the material that forms the second shaft 622 and the third shaft 624 is fixedly attached to the second frame 618 (e.g., outer ring 648) such that the third shaft 624 cannot be separated from the second frame 618 without damaging the material that forms the third shaft 624. In the illustrated embodiment, as shown in FIGS. 85, 86, and 87, each of the second shaft 622 and the third shaft 624 has a first end 755, which is attached to an outer ring 648, a second end 759, a length 761 (e.g., 25 inches) that extends from the first end 755 to the second end 759, a first outside diameter 763 (e.g., 1.96 inches), a second outside diameter 765 (e.g., 2.5 inches), a third outside diameter 801 (e.g., 1.5 inches), and a main body 956 that defines a passageway 757. The passageway 757 extends from the second end 759 toward the first end 755. The passageway 757 has an inside diameter 961 (e.g., 1.62 inches) and a length 963 (e.g., 12 inches). The first outside diameter 763 extends from the second end 759 toward the first end 755 a distance (e.g., 15.4 inches). The second outside diameter 765 (e.g., which forms a collar) extends from a portion of the main body 956 that has the first outside diameter 763 to a portion of the main body 956 that has the third outside diameter 801 a distance (e.g., 1.62 inches). The third outside diameter 801 extends from the first end 755 toward the second end 759 a distance (e.g., 7.98 inches).

Each set screw of the plurality of set screws 750 (e.g., 0.50 inch set screw) is sized and configured to be received by a passageway 754, 756 defined by the first shaft main body 634 and a first elongate member groove 764. Each set screw of the plurality of set screws 750 defines a thread 768 that is sized and configured to mate with a thread of the plurality of threads 758 defined by the first shaft main body 634. Each set screw of the plurality of set screws 750 is movable between a first configuration in which the set screw is disposed within a passageway 754, 756 and is not disposed within a first elongate member groove 764 and a second configuration in which the set screw is disposed within a passageway 754, 756 and is disposed within a first elongate member groove 764. In the first configuration, the first shaft 612 is free of attachment to a frame and can be moved relative to the frame, or removed from the frame. In the second configuration, the set screw releasably attaches the first shaft 612 to a frame that defines the groove within which the set screw is disposed. The inclusion of a first elongate member groove 764 and a plurality of set screws 750 provide a mechanism to manipulate the position of a frame relative to a first shaft such that an exercise apparatus can be customized to a desired lifting position and maintain the alignment and/or attachment between a first shaft and a handle.

Figure 88:
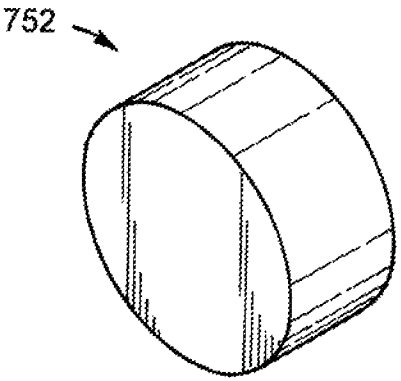
FIG. 88 is a perspective view of a plug of the exercise apparatus illustrated in FIG. 41.
Figure 90:
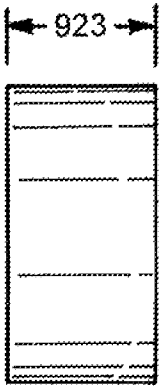
FIG. 90 is a side view of the plug illustrated in FIG. 88.
Figure 89:
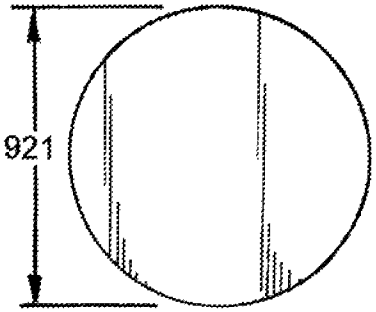
FIG. 89 is a front view of the plug illustrated in FIG. 88.
Figure 93:
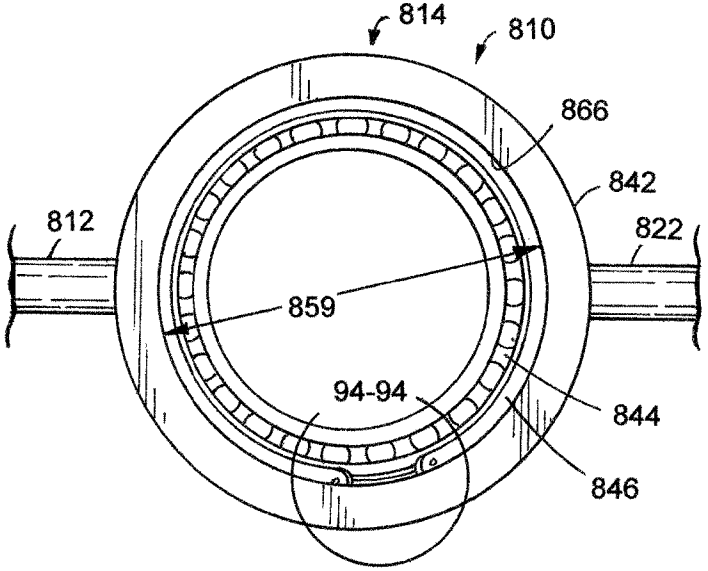
FIG. 93 is a rear view of the exercise apparatus illustrated in FIG. 91 with the first cover and the second cover removed from the frame.
Figure 94:
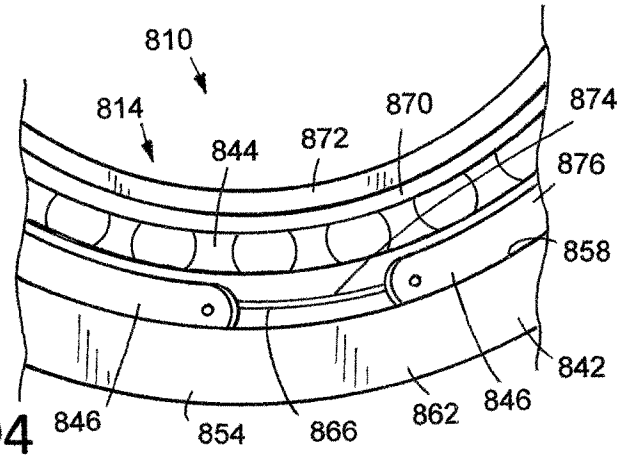
FIG. 94 is a magnified view of area 94-94 in FIG. 93.
Figure 91:
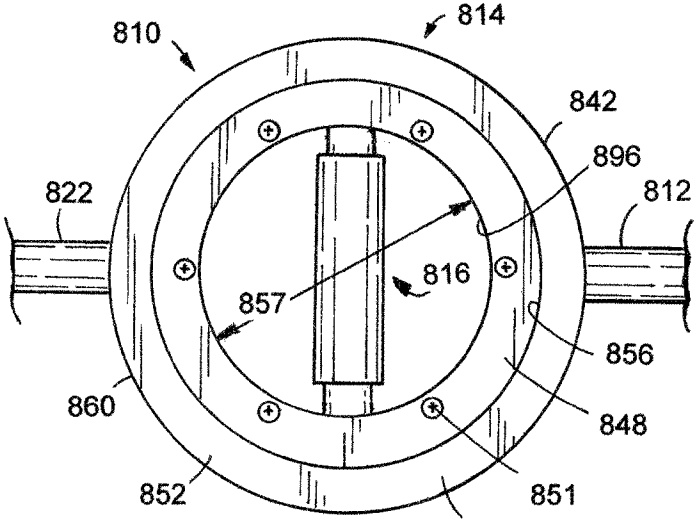
FIG. 91 is a partial front view of another example exercise apparatus.
Figure 92:
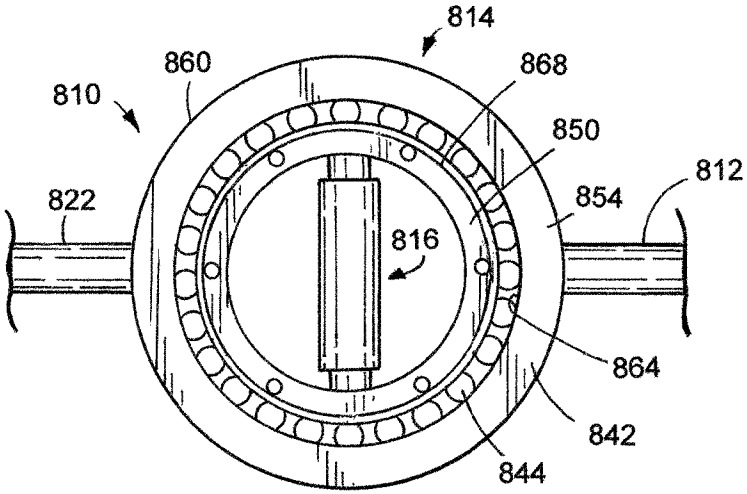
FIG. 92 is another partial front view of the exercise apparatus illustrated in FIG. 91 with the first cover removed from the frame.
Figure 97:
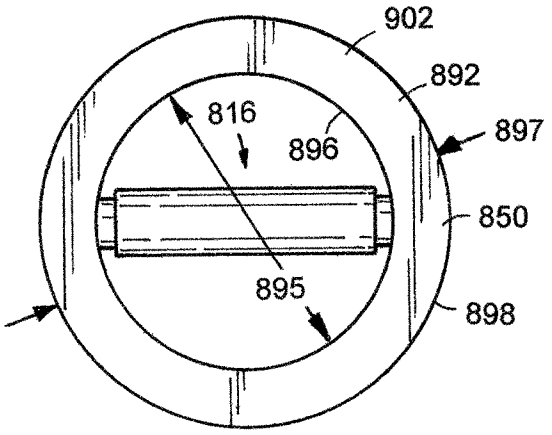
FIG. 97 is a perspective view of the second cover of a frame of the exercise apparatus illustrated in FIG. 91 free of attachment to the frame.
Figure 96:
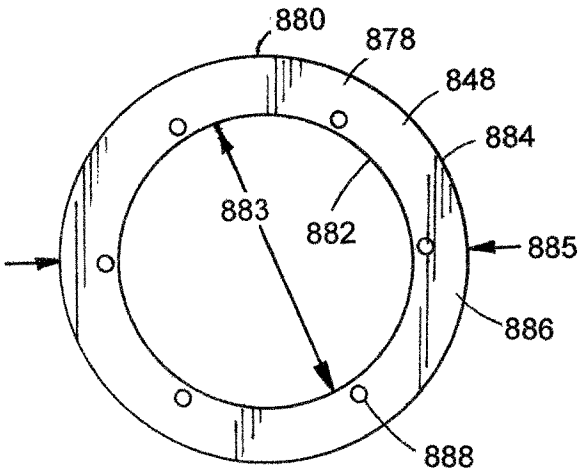
FIG. 96 is a perspective view of the first cover of a frame of the exercise apparatus illustrated in FIG. 91 free of attachment to the frame.
Figure 95:
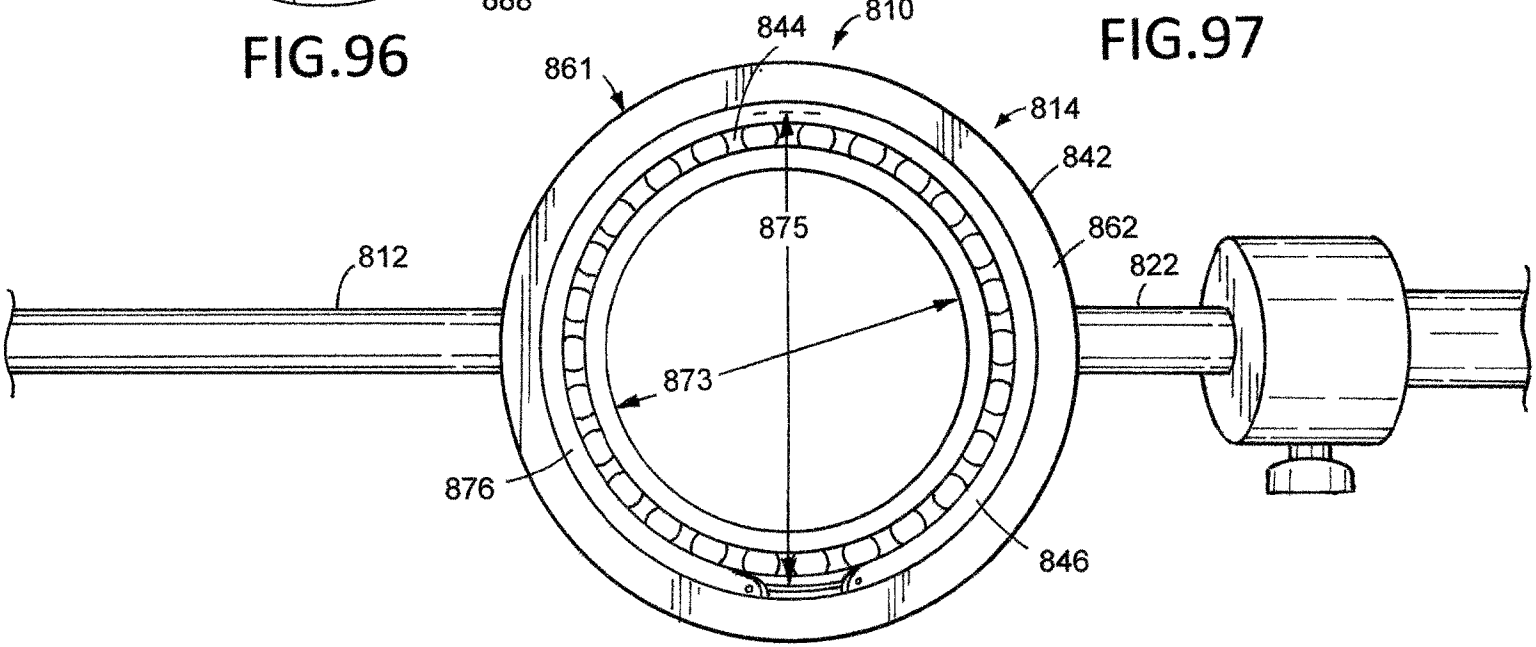
FIG. 95 is a rear partial perspective view of the exercise apparatus illustrated in FIG. 91 with the first cover and the second cover removed from the frame.
Figure 98:
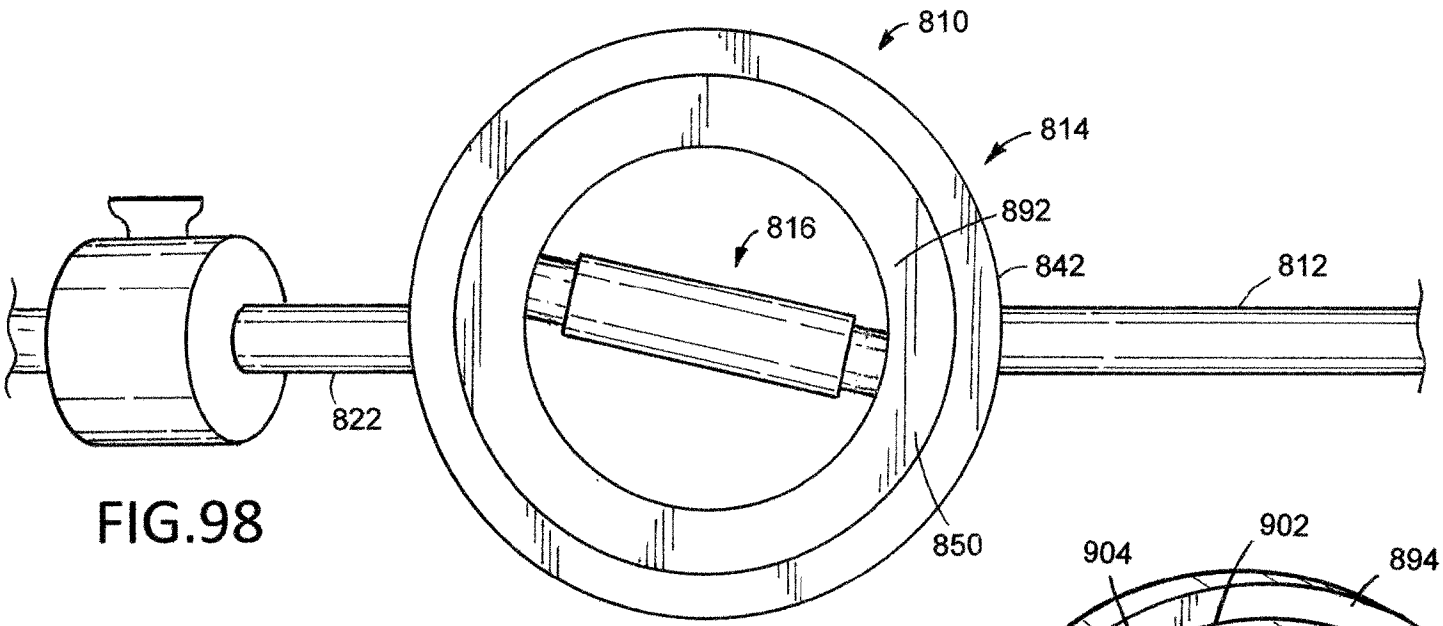
FIG. 98 is a rear partial perspective view of the exercise apparatus illustrated in FIG. 91.
Figure 99:
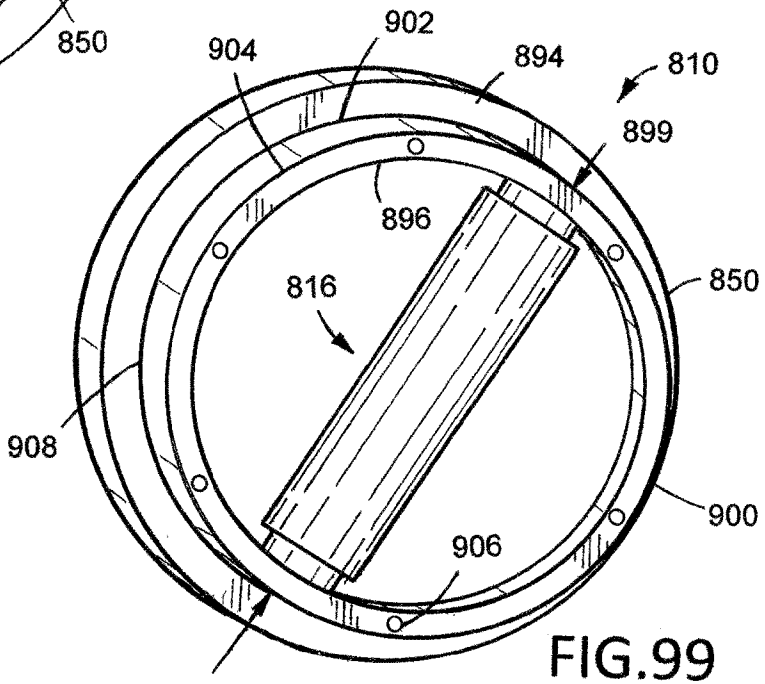
FIG. 99 is another perspective view of the second cover of a frame of the exercise apparatus illustrated in FIG. 91 free of attachment to the frame.

As shown in FIGS. 88, 89, and 90, each plug of the plurality of plugs 752 is sized and configured to be received by a passageway 760, 762 defined by the first shaft main body 634. Each plug of the plurality of plugs 752 has an outside diameter 921 (e.g., 0.5 inches), a thickness 923 (e.g., 0.25 inches), and is attached (e.g., welded) to the first shaft 612 within a passageway 760, 762. Each plug of the plurality of plugs 752 has a thickness 923 that is greater than the thickness of the first shaft 612 such that each plug is partially disposed within a first elongate member groove 764 when the device is assembled to prevent a handle from becoming free from the first shaft 612 during use.

To assemble the exercise apparatus, a first elongate member 650 attached to the first frame 614 is positioned within the first shaft first passageway 636 and attached to the first shaft 612 using a set screw 750 and a plug 752 and a first elongate member 650 attached to the second frame 618 is positioned within the first shaft first passageway 636 and attached to the first shaft 612 using a set screw 750 and a plug 752. Each of the plugs 752 is positioned within a passageway 760, 762 and attached to the first shaft 612 such that each of the first frame 614 and second frame 618 is moveably attached to the first shaft 612. Each of the set screws 750 can be moved between its first and second configurations to adjust the position of a first frame 614 and/or second frame 618 relative to the first shaft 612. In use, each of the handles 616, 620, the first inner ring 642, the second inner ring 644, the third inner ring 646, and the fourth inner ring 647 is moveable relative to the outer ring 648 such that rotation of the handles can be achieved to relieve excessive stresses on the shoulders and surrounding soft tissues. During movement of the various features of the exercise apparatus 610, the first plurality of a plurality of wheels 770 contact a cover 633, 635 and prevent movement of a handle 626, 620 on an axis that extends through the passageway 656 defined by a frame 614, 618 and the second plurality of wheels 774 contact an outer ring inner surface 700 resulting in rotational movement of a handle 626, 620. In alternative embodiments, the set screws of an exercise apparatus can be left in the first configuration such that a first frame and/or a second frame can be moved dynamically relative to a first shaft during use. In these alternative embodiments, optional components can be included to assist with such dynamic movement (e.g., bearing along length of interface between a first shaft and a frame).

FIGS. 91 through 99 illustrate another example exercise apparatus 810. The exercise apparatus 810 is similar to the exercise apparatus 10 illustrated in FIGS. 1 through 32 and described above, except as detailed below. In the illustrated embodiment, the exercise apparatus 810 has a first shaft 812, a first frame 814, a first handle 816, and a second shaft 822.

In the illustrated embodiment, the first frame 814 is fixedly attached to the first shaft 812 and the second shaft 822. The first frame 814 includes an outer ring 842, a bearing 844, a retaining ring 846, a first cover 848, a second cover 850, and a plurality of fasteners 851.

In the illustrated embodiment, the outer ring 842 has an outer ring first surface 852, an outer ring second surface 854, an outer ring first inner surface 856, an outer ring second inner surface 858, an outer ring outer surface 860, an outer ring first inside diameter 857, an outer ring second inside diameter 859, an outer ring outside diameter 861, and an outer ring main body 862 that defines an outer ring shoulder 864 and an outer ring recess 866. The outer ring first inside diameter 857 is less than the outer ring second inside diameter 859. The outer ring shoulder 864 is disposed at the transition between the outer ring first inside diameter 857 and the outer ring second inside diameter 859. The outer ring recess 866 extends into the outer ring main body 862 from the outer ring second inner surface 858 and is sized and configured to receive a portion of the retaining ring 846. A length of the outer ring second inner surface 858 extends from the outer ring recess 866 to the outer ring shoulder 864 and is equal to about the thickness of the bearing 844 such that the bearing 844 can be disposed between the outer ring shoulder 864 and the retaining ring 846. While the outer ring 842 has been illustrated as having a particular structural arrangement and as having various dimensions, an outer ring of an exercise apparatus can have any suitable structural arrangement and dimensions. Selection of suitable structural arrangement and dimensions for an outer ring can be based on various considerations, including the intended use of the exercise apparatus of which the outer ring is included.

The bearing 844 is disposed between the outer ring shoulder 864 and the retaining ring 846 such that it contacts the outer ring shoulder 864 and retaining ring 846. The bearing 844 has a bearing first surface 868, a bearing second surface 870, a bearing inner surface 872, a bearing outer surface 874, a bearing inside diameter 873, and a bearing outside diameter 875. The bearing inside diameter 873 is less than the outer ring first inside diameter 857. The bearing outside diameter 875 is greater than the outer ring first inside diameter 857 and less than the outer ring second inside diameter 859 such that the bearing can be positioned within the outer ring 842. The bearing first surface 868 contacts the outer ring shoulder 864 and the bearing second surface 870 contacts the retaining ring 846. Any suitable bearing can be included in a frame of an exercise apparatus and selection of a suitable bearing can be based on various considerations, including the intended use of the exercise apparatus of which the bearing is a component. Examples of bearings considered suitable to include in a frame of an exercise apparatus include plain bearings, ball bearings, deep groove ball bearings, roller bearings, and any other bearing considered suitable for a particular embodiment. While the bearing 844 has been illustrated as having a particular structural arrangement and as having various dimensions, a bearing of an exercise apparatus can have any suitable structural arrangement and dimensions. Selection of suitable structural arrangement and dimensions for a bearing can be based on various considerations, including the intended use of the exercise apparatus of which the bearing is included.

The retaining ring 846 has a thickness and a main body 876 that defines a partial cylinder. The retaining ring 846 is moveable between a first, collapsed configuration and a second, expanded configuration. The retaining ring 846 is biased to the second, expanded configuration. In the first, collapsed configuration the retaining ring 846 has an outside diameter that is less than the outer ring second inside diameter 859 such that the retaining ring can be positioned adjacent the outer ring recess 866. In the second, expanded configuration the retaining ring has a second outside diameter that is greater than the outer ring second inside diameter 859 and less than the bearing outside diameter 875 such that the retaining ring 846 can be releasably disposed within the outer ring recess 866 and contact the bearing 844. While the retaining ring 846 has been illustrated as having a particular structural arrangement and as having various dimensions, a retaining ring of an exercise apparatus can have any suitable structural arrangement and dimensions. Selection of suitable structural arrangement and dimensions for a retaining ring can be based on various considerations, including the intended use of the exercise apparatus of which the retaining ring is included.

The first cover 848 has a first cover first surface 878, a first cover second surface 880, a first cover inner surface 882, a first cover outer surface 884, a first cover inside diameter 883, a first cover outside diameter 885, and a first cover main body 886 that defines a plurality of passageways 888. The first cover inside diameter 883 is less than the bearing inside diameter 873 and is equal to about the second cover inside diameter 895, as described below. The first cover outside diameter 885 is equal to about the outer ring first inside diameter 857. Each passageway of the plurality of passageways 888 is sized and configured to receive a portion of a fastener of the plurality of fasteners 851 and extends through the thickness of the first cover 848 from the first cover first surface 878 to the first cover second surface 880. While the first cover 848 has been illustrated as having a particular structural arrangement and as having various dimensions, a first cover of an exercise apparatus can have any suitable structural arrangement and dimensions. Selection of suitable structural arrangement and dimensions for a first cover can be based on various considerations, including the intended use of the exercise apparatus of which the first cover is included.

The second cover 850 has a second cover first surface 892, a second cover second surface 894, a second cover inner surface 896, a second cover first outer surface 898, a second cover second outer surface 900, a second cover inside diameter 895, a second cover first outside diameter 897, a second cover second outside diameter 899, and a second cover main body 902 that defines a projection 904 and a plurality of passageways 906. The first handle 816 is fixedly attached to the second cover 850 and extends across the second cover inside diameter 895. The second cover inside diameter 895 is less than the bearing inside diameter 873. The second cover first outside diameter 897 is equal to about the outer ring second inside diameter 859. The second cover second outside diameter 899 is less than the a bearing inside diameter 873. The projection 904 extends from second cover second surface 894 and defines a shoulder 908 with the second surface 894 that contacts and interfaces with the retaining ring 846 to secure the retaining ring 846 and bearing 844 within the first frame 814. Each passageway of the plurality of passageways 906 is sized and configured to receive a portion of a fastener of the plurality of fasteners 851 and extends into the projection 904. When assembled, each passageway of the plurality of passageways 906 is aligned (e.g., coaxial with) a passageway of the plurality of passageways 888. While the second cover 850 has been illustrated as having a particular structural arrangement and as having various dimensions, a second cover of an exercise apparatus can have any suitable structural arrangement and dimensions. Selection of suitable structural arrangement and dimensions for a second cover can be based on various considerations, including the intended use of the exercise apparatus of which the second cover is included.

Each fastener of the plurality of fasteners 851 is sized and configured to be partially disposed through a portion of a passageway of the plurality of passageways 888 and a passageway of the plurality of passageways 906 to releasably attached the first and second covers 848, 850 to the first frame. Any suitable fastener can be used in an exercise apparatus and selection of a suitable fastener can be based on various considerations, including the materials that form a cover. Examples of suitable fasteners that can be used in an exercise apparatus include threaded fasteners, screws, bolts, and any other fastener considered suitable for a particular embodiment.

To assemble the exercise apparatus 810, the bearing 844 is positioned within the outer ring 842 such that the bearing first surface 868 contacts the outer ring shoulder 864. Subsequently, the retaining ring 846 is positioned within the outer ring recess 866 to releasably position the retaining ring 846 within the recess 866 and releasably position the bearing 844 within the first frame 814. The second cover 850 is then positioned through the passageway defined by the bearing 844 and the first cover 848 is releasably attached to the second cover 850 using the plurality of fasteners 851.

Figure 100:
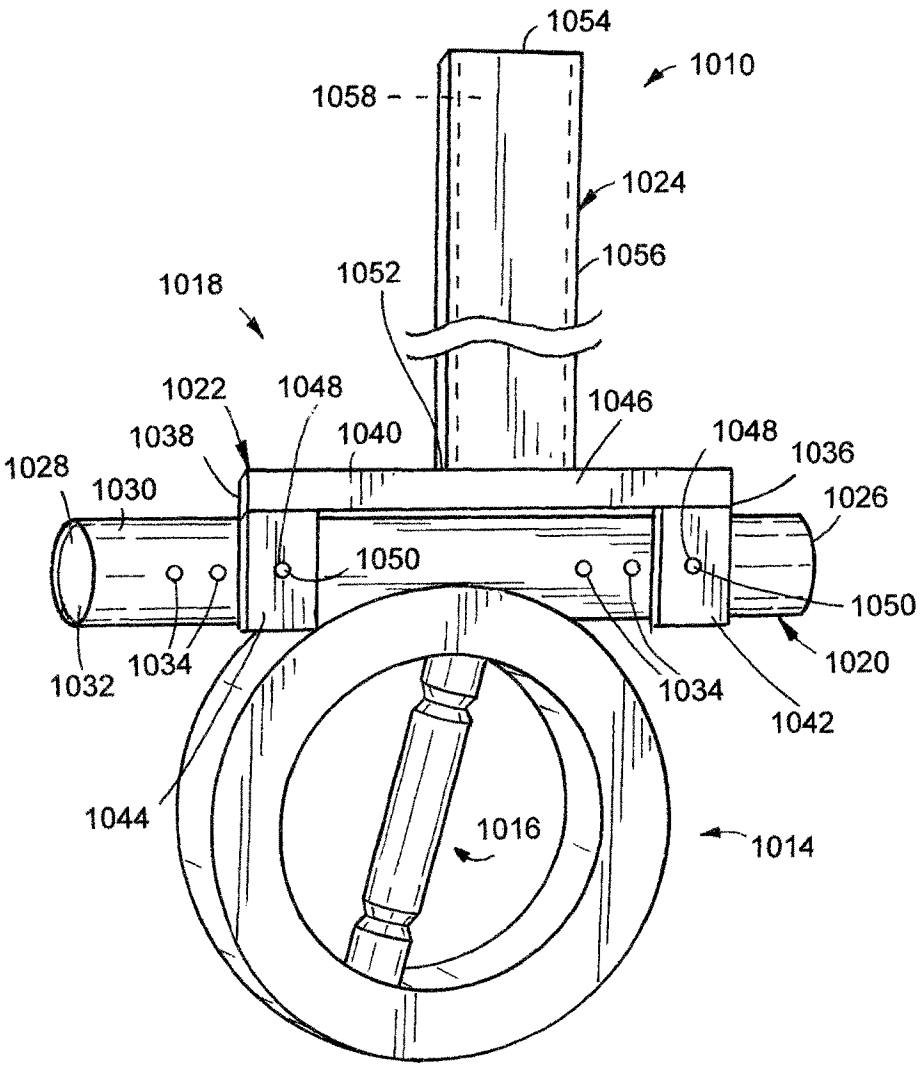
FIG. 100 is a perspective view of another example exercise apparatus.

FIG. 100 illustrates another example exercise apparatus 1010. The exercise apparatus 1010 is similar to the exercise apparatus 810 illustrated in FIGS. 91 through 99 and described above, except as detailed below. In the illustrated embodiment, the exercise apparatus 1010 has a frame 1014, a handle 1016, and an attachment member 1018. The frame 1014 and handle 1016 are similar to the first frame 814 and first handle 816 described above, except as described below.

In the illustrated embodiment, the frame 1014 is attached (e.g., releasably, fixedly) to the attachment member 1018, which is adapted to be releasably attached to another device (e.g., a dip rack handle). The attachment member 1018 has a first elongate member 1020, a guide member 1022 moveably attached to the first elongate member 1020, and a second elongate member 1024. The first elongate member 1018 has a first end 1026, a second end 1028, and a main body 1030 that defines a passageway 1032 and a plurality of passageways 1034. The passageway 1032 extends from the first end 1026 to the second end 1028. Each passageway of the plurality of passageways 1034 extends through the main body 1030 and provides access to the passageway 1032. Each passageway of the plurality of passageways 1034 is sized and configured to receive a portion of a locking pin 1050, as described below.

The guide 1022 is moveably attached to the first elongate member 1022 and has a first end 1036, a second end 1038, and a main body 1040 that defines a first projection 1042, a second projection 1044, an elongate member 1046 attached to each of the first projection 1042 and the second projection 1044, and a passageway 1048 on each projection 1042, 1044. Each of the first projection 1042 and the second projection 1044 is a ring member that is adapted to receive the first elongate member 1020 and slide across the length of the first elongate member 1020. A locking pin 1050 is disposed within each passageway 1048 and is spring loaded such that it is biased toward the lengthwise axis of the first elongate member 1020 and can be disposed within a passageway of the plurality of passageways 1034 to provide releasable attachment between the guide 1022 and the first elongate member 1020. Each locking pin of the plurality of locking pins 1050 is movable between a first configuration in which the locking pin is disposed within a passageway 1048 and is not disposed within a passageway 1034 and a second configuration in which the locking pin is disposed within a passageway 1048 and is disposed within a passageway 1034. In the first configuration, the guide 1022 can be moved relative to the first elongate member 1020. In the second configuration, the locking pin releasably attaches the guide 1022 to the first elongate member 1020. The inclusion of a passageways 1034, 1048 and locking pins 1050 provide a mechanism to manipulate the position of a handle relative to the guide 1022 such that an exercise apparatus can be customized to a desired position.

The second elongate member 1024 has a first end 1052 attached to the guide 1022, a second end 1054, and a main body 1056 that defines a passageway 1058 that extends from the first end 1052 to the second end 1054. The passageway 1058 is adapted to receive a portion of a second exercise apparatus (e.g., the handle of a dip rack) to provide a user with the ability to include a rotatable handle when using the second exercise apparatus.

Figure 101:
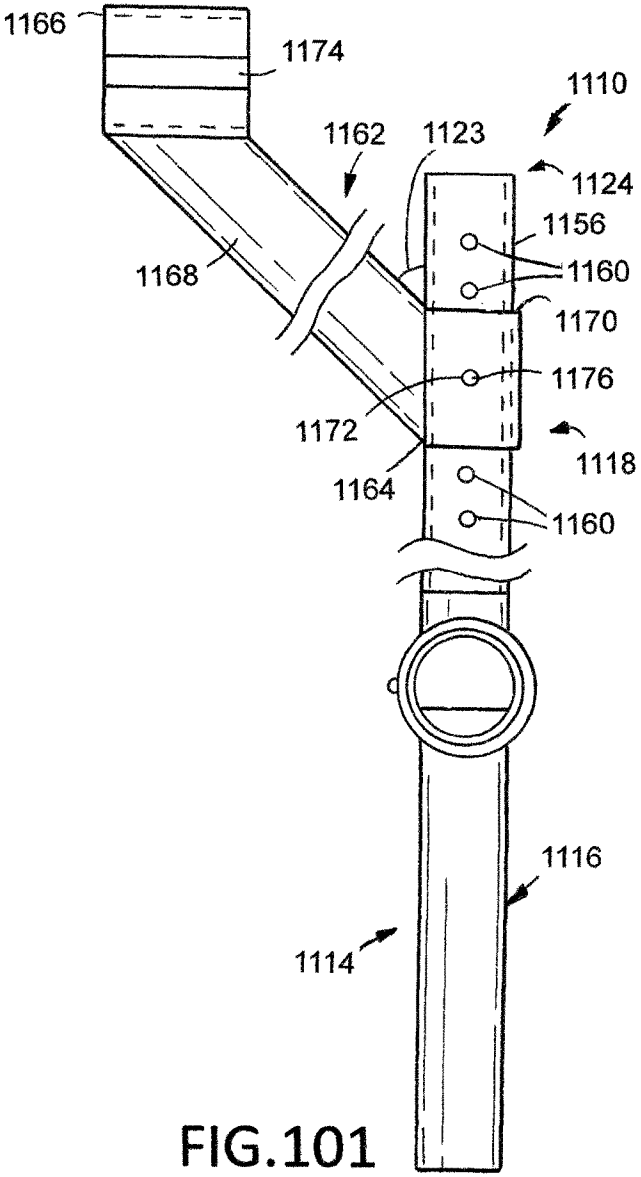
FIG. 101 is a side view of another example exercise apparatus.

FIG. 101 illustrates another example exercise apparatus 1110. The exercise apparatus 1110 is similar to the exercise apparatus 1010 illustrated in FIG. 100 and described above, except as detailed below. In the illustrated embodiment, the exercise apparatus 1110 has a frame 1114, a handle 1116, and an attachment member 1118. In the illustrated embodiment, the main body 1156 of the second elongate member 1124 defines a plurality of passageways 1160. In addition, the attachment member 1118 includes a third elongate member 1162 that extends from the second elongate member 1124 at an angle 1123 between about 15 degrees and about 75 degrees. The third elongate member 1162 is moveably attached to the second elongate member 1124 and has a first end 1164, a second end 1166, and a main body 1168 that defines a first passageway 1170, a second passageway 1172, and a third passageway 1174. The first end 1164 is a ring member that is adapted to receive the second elongate member 1124 and slide across the length of the second elongate member 1124. A locking pin 1176 is disposed within the second passageway 1172 and is spring loaded such that it is biased toward the lengthwise axis of the second elongate member 1124 and can be disposed within a passageway of the plurality of passageways 1160 to provide releasable attachment between the third elongate member 1162 and the second elongate member 1124. The locking pin 1176 is movable between a first configuration in which the locking pin is disposed within the second passageway 1172 and is not disposed within a passageway 1160 and a second configuration in which the locking pin 1176 is disposed within the second passageway 1172 and is disposed within a passageway 1160. In the first configuration, the third elongate member 1162 can be moved relative to the second elongate member 1124. In the second configuration, the locking pin 1176 releasably attaches the third elongate member 1162 to the second elongate member 1124. The inclusion of a passageways 1160, 1172 and locking pin 1176 provide a mechanism to manipulate the position of a handle relative to a third elongate member 1124 such that an exercise apparatus can be customized to a desired position. The second end 1166 of the third elongate member 1162 is adapted to releasably attach the third elongate member 1162 to a support of a second exercise apparatus (e.g., a vertical post of a dip rack adjacent a handle of the dip rack, a horizontal post of a dip rack adjacent a handle of the dip rack) to provide additional support of the exercise apparatus 1110 during use. A second end of a third elongate member can include any suitable structure to achieve releasable attachment to a support, such as a clamp, a clip, or any other structure considered suitable for a particular embodiment.

FIGS. 102 and 103 illustrate another example exercise apparatus 1210. The exercise apparatus 1210 is similar to the exercise apparatus 1010 illustrated in FIG. 100 and described above, except as detailed below. In the illustrated embodiment, the exercise apparatus 1210 has a frame 1214, a handle 1216, and an attachment member 1218.

In the illustrated embodiment, the frame 1214 is attached (e.g., releasably, fixedly) to the attachment member 1218, which is adapted to be releasably attached to another device (e.g., a bench press handle). The attachment member 1218 has a first elongate member 1220, a second elongate member 1222, and a third elongate member 1224. Each of the first elongate member 1220 and the second elongate member 1222 is fixedly attached to the frame 1214 and has a main body 1226 that defines a ring 1228 through which the third elongate member is disposed 1224 and a passageway 1230 through which a locking pin 1232 is disposed.

The third elongate member 1224 has a first end 1234, a second end 1236, and a main body 1238 that defines a passageway 1240 and a plurality of passageways 1242. The passageway 1240 extends from the first end 1234 to the second end 1236 and is adapted to receive the handle of a second exercise apparatus (e.g., handle of bench press machine). Each passageway of the plurality of passageways 1242 extends through the main body 1238 and provides access to the passageway 1240. Each locking pin 1232 is disposed within the passageway 1230 and is spring loaded such that it is biased toward the lengthwise axis of the third elongate member 1224 and can be disposed within a passageway of the plurality of passageways 1242 to provide releasable attachment between the first and second elongate members 1220, 1222 and the third elongate member 1224. Each locking pin 1232 is movable between a first configuration in which the locking pin is disposed within the passageway 1230 and is not disposed within a passageway 1242 and a second configuration in which the locking pin 1232 is disposed within the passageway 1230 and is disposed within a passageway 1242. In the first configuration, each of the first and second elongate members 1220, 1222 can be moved relative to the third elongate member 1224. In the second configuration, a first locking pin 1232 releasably attaches the first elongate member 1220 to the third elongate member 1224 and a second locking pin 1232 releasably attaches the second elongate member 1220 to the third elongate member 1224. The inclusion of a passageways 1230, 1242 and locking pins 1232 provide a mechanism to manipulate the position of a handle relative to a third elongate member 1224 such that an exercise apparatus can be customized to a desired position.

FIG. 104 illustrates another example exercise apparatus 1310. The exercise apparatus 1310 is similar to the exercise apparatus 1210 illustrated in FIGS. 102 and 103 and described above, except as detailed below. In the illustrated embodiment, the exercise apparatus 1310 has a frame 1314, a handle 1316, and an attachment member 1318. In the illustrated embodiment, the attachment member 1318 includes a fourth elongate member 1344 that extends from the third elongate member 1324 at an angle 1323 between about 15 degrees and about 75 degrees. The fourth elongate member 1344 has a first end 1346 attached to the third elongate member 1324, a second end 1348, and a main body 1350 that defines a passageway 1352. The second end 1348 is adapted to releasably attach the fourth elongate member 1344 to a support of a second exercise apparatus (e.g., a vertical post of a bench press machine adjacent a handle of the bench press machine, a horizontal post of a bench press machine adjacent a handle of the bench press machine) to provide additional support of the exercise apparatus 1310 during use. A second end of a fourth elongate member can include any suitable structure to achieve releasable attachment to a support, such as a clamp, a clip, or any other structure considered suitable for a particular embodiment. Optionally, an elongate member (e.g., fourth elongate member) can be pivotable relative to the component to which it is attached (e.g., third elongate member).

Figure 105:
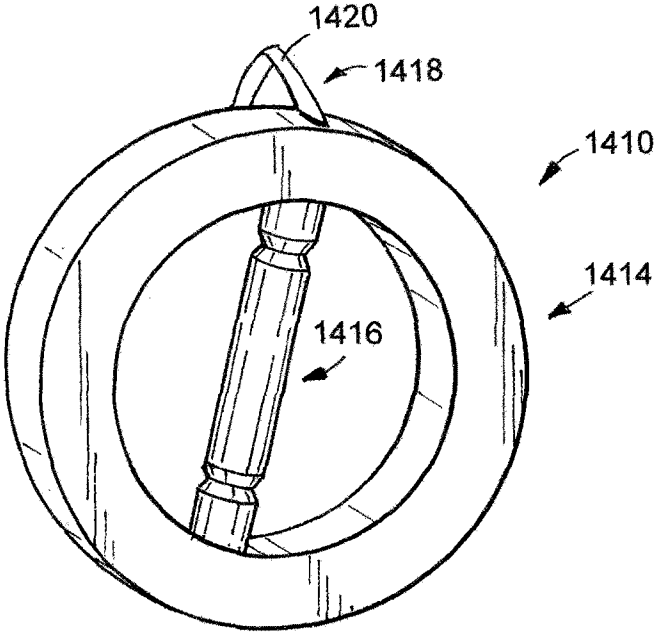
FIG. 105 is a perspective view of another example exercise apparatus.

FIG. 105 illustrates another example exercise apparatus 1410. The exercise apparatus 1410 is similar to the exercise apparatus 1210 illustrated in FIGS. 102 and 103 and described above, except as detailed below. In the illustrated embodiment, the exercise apparatus 1410 has a frame 1414, a handle 1416, and an attachment member 1418. In the illustrated embodiment, the attachment member 1418 is attached to the frame 1414 and comprises is a bracket 1420 that defines a passageway 1422 adapted to receive a portion of a second exercise apparatus (e.g., a hook, or clip, of a weight lifting apparatus).

Figure 106:
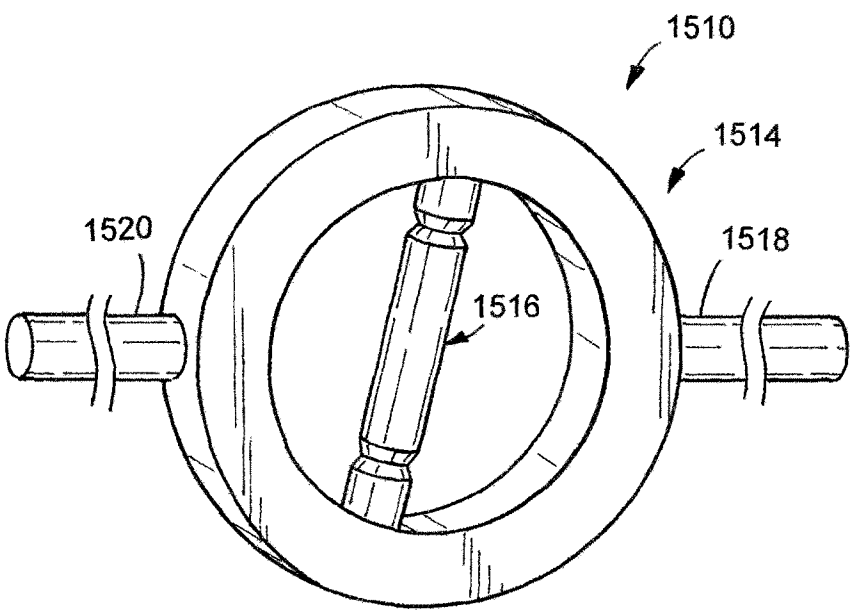
FIG. 106 is a perspective view of another example exercise apparatus.

FIG. 106 illustrates another example exercise apparatus 1510. The exercise apparatus 1510 is similar to the exercise apparatus 1210 illustrated in FIGS. 102 and 103 and described above, except as detailed below. In the illustrated embodiment, the exercise apparatus 1510 has a frame 1514, a handle 1516, and includes a first shaft 1518 and a second shaft 1520 attached to the frame 1514. Each of the first shaft 1518 and the second shaft 1520 is adapted to receive one or more free weights and/or a clamp to releasably attached the one or more free weights to the shaft. The structural arrangement of the exercise apparatus 1510 allows a user to utilize the exercise apparatus to perform various weight lifting activities, such as curls and any other activity considered suitable.

While some of the embodiments illustrated herein relate to various configurations for bench press bars, an exercise apparatus can form any suitable structure. Selection of a suitable structure to incorporate an exercise apparatus, as described herein, can be based on various considerations, including the exercise intended to be accomplished. Examples of suitable structures to incorporate an exercise apparatus, such as those described herein, include barbells (e.g., exercise apparatus 1510, an exercise apparatus can include a first frame and a first handle, the first frame can include first and second elongate members that can be sized and configured to receive one or more free weights or can include weights that are integral components of the first and second elongate members), handles for exercise machines (e.g., exercise apparatus 1010, exercise apparatus 1110, exercise apparatus 1210, exercise apparatus 1310, exercise apparatus 1410, an exercise apparatus can include a first frame and a first handle, the first frame can omit the inclusion of first and second elongate members and include an eyelet attached to an outer ring such that the first frame can be releasably attached to a separate component (e.g., wired lift machine)), grips for exercise machines, and any other structure considered suitable for a particular embodiment. For example, a frame and a handle (e.g., first frame, second frame, first handle, second handle), such as those described herein, can be claimed without any other component and/or can omit any of the components associated with a frame and/or handle.

Those with ordinary skill in the art will appreciate that various modifications and alternatives for the described and illustrated embodiments can be developed in light of the overall teachings of the disclosure. Accordingly, the particular arrangements disclosed are intended to be illustrative only and not limiting as to the scope of the invention, which is to be given the full breadth of the appended claims and any and all equivalents thereof.

What is claimed is:

1. An exercise apparatus comprising:

a first shaft having a first shaft first end and a first shaft second end;

a first frame attached to the first shaft first end, the first frame having an outer ring, a first inner ring, and defining a first frame passageway, the first inner ring rotatably disposed within the outer ring;

a first handle having a handle outer ring and a handle shaft, the handle outer ring attached to the first inner ring such that the first handle is rotatably attached to the first frame, the handle shaft attached to the handle outer ring and extending across the first frame passageway;

a second frame attached to the first shaft second end, the second frame defining a second frame passageway;

a second handle rotatably attached to the second frame and extending across the second frame passageway;

a second shaft having a second shaft first end and a second shaft second end, the second shaft first end attached to the first frame; and a third shaft having a third shaft first end and a third shaft second end, the third shaft first end attached to the second frame.

2. The exercise apparatus of claim 1, wherein the first frame is releasably attached to the first shaft.

3. The exercise apparatus of claim 1, wherein the second frame is releasably attached to the first shaft.

4. The exercise apparatus of claim 1, wherein the first handle has 360 degrees of rotation relative to the first frame.

5. The exercise apparatus of claim 1, wherein the second handle has 360 degrees of rotation relative to the second frame.

6. The exercise apparatus of claim 1, wherein the first frame is moveable relative to the first shaft.

7. The exercise apparatus of claim 1, wherein the first shaft has a first shaft length; and wherein the first frame is moveable along the first shaft length.

8. The exercise apparatus of claim 1, wherein the second frame is moveable relative to the first shaft.

9. The exercise apparatus of claim 1, wherein the first shaft has a first shaft length; and wherein the second frame is moveable along the first shaft length.

10. The exercise apparatus of claim 1, wherein the first frame is moveable relative to the first shaft; and wherein the second frame is moveable relative to the first shaft.

11. The exercise apparatus of claim 1, wherein the second shaft is moveable relative to the first frame.

12. The exercise apparatus of claim 1, wherein the second shaft has a second shaft length that extends from the second shaft first end to the second shaft second end, a second shaft first outside diameter at the second shaft first end, and a second shaft second outside diameter disposed between the second shaft first end and the second shaft second end; and wherein the second shaft first outside diameter is less than the second shaft second outside diameter.

13. The exercise apparatus of claim 1, wherein the third shaft has a third shaft length that extends from the third shaft first end to the third shaft second end, a third shaft first outside diameter at the third shaft first end, and a third shaft second outside diameter disposed between the third shaft first end and the third shaft second end; and wherein the third shaft first outside diameter is less than the third shaft second outside diameter.

14. The exercise apparatus of claim 1, wherein the first handle partially extends across the first frame passageway.

15. The exercise apparatus of claim 1, wherein the second handle partially extends across the second frame passageway.

16. The exercise apparatus of claim 1, wherein the first frame has a second inner ring and a third inner ring, the first inner ring disposed between the second inner ring and the third inner ring; and wherein the outer ring is attached to each of the second inner ring and the third inner ring.

17. The exercise apparatus of claim 16, wherein the first frame has a plurality of ball bearings, a first set of ball bearings of the plurality of ball bearings disposed between the first inner ring and the second inner ring, a second set of ball bearings of the plurality of ball bearings disposed between the first inner ring and the third inner ring.

18. An exercise apparatus comprising:

a first shaft having a first shaft first end and a first shaft second end;

a first frame releasably attached to the first shaft first end, the first frame having an outer ring, a first inner ring, and defining a first frame passageway, the first inner ring rotatably disposed within the outer ring;

a first handle having a handle outer ring and a handle shaft, the handle outer ring attached to the first inner ring such that the first handle is rotatably attached to the first frame, the handle shaft attached to the handle outer ring and extending across the first frame passageway;

a second frame releasably attached to the first shaft second end, the second frame defining a second frame passageway;

a second handle rotatably attached to the second frame and extending across the second frame passageway;

a second shaft having a second shaft first end and a second shaft second end, the second shaft first end attached to the first frame; and a third shaft having a third shaft first end and a third shaft second end, the third shaft first end attached to the second frame.

19. The exercise apparatus of claim 18, wherein the first handle has 360 degrees of rotation relative to the first frame; and wherein the second handle has 360 degrees of rotation relative to the second frame.

20. An exercise apparatus comprising:

a first shaft having a first shaft first end and a first shaft second end;

a first frame releasably attached to the first shaft first end, the first frame having an outer ring, a first inner ring, and defining a first frame passageway, the first inner ring rotatably disposed within the outer ring, the first frame movable relative to the first shaft;

a first handle having a handle outer ring and a handle shaft, the handle outer ring attached to the first inner ring such that the first handle is rotatably attached to the first frame, the handle shaft attached to the handle outer ring and extending across the first frame passageway, the first handle having 360 degrees of rotation relative to the first frame;

a second frame releasably attached to the first shaft second end, the second frame defining a second frame passageway, the second frame movable relative to the first shaft;

a second handle rotatably attached to the second frame and extending across the second frame passageway, the second handle having 360 degrees of rotation relative to the second frame;

a second shaft having a second shaft first end and a second shaft second end, the second shaft first end attached to the first frame; and a third shaft having a third shaft first end and a third shaft second end, the third shaft first end attached to the second frame.

* * * * *